US009082338B2

(12) United States Patent
Yaras et al.

(10) Patent No.: US 9,082,338 B2
(45) Date of Patent: Jul. 14, 2015

(54) DISPLAY APPARATUS CONFIGURED FOR SELECTIVE ILLUMINATION OF IMAGE SUBFRAMES

(71) Applicant: Pixtronix, Inc., San Diego, CA (US)

(72) Inventors: Fahri Yaras, Chelsea, MA (US); Edward Buckley, Melrose, MA (US); John Paul Beck, Tyngsboro, MA (US)

(73) Assignee: Pixtronix, Inc., San Diego, CA (US)

( * ) Notice: Subject to any disclaimer, the term of this patent is extended or adjusted under 35 U.S.C. 154(b) by 190 days.

(21) Appl. No.: 13/828,211

(22) Filed: Mar. 14, 2013

(65) Prior Publication Data

US 2014/0267445 A1 Sep. 18, 2014

(51) Int. Cl.

| | |
|---|---|
| ***G09G 5/10*** | (2006.01) |
| ***G09G 3/20*** | (2006.01) |
| *G09G 3/34* | (2006.01) |

(52) U.S. Cl.

CPC ..... *G09G 3/2003* (2013.01); *G09G 3/2037* (2013.01); *G09G 3/2022* (2013.01); *G09G 3/2033* (2013.01); *G09G 3/3406* (2013.01); *G09G 3/3433* (2013.01);

(Continued)

(58) Field of Classification Search

CPC . G09G 3/2003; G09G 3/2014; G09G 3/2018; G09G 3/0276; G09G 3/2022; G09G 3/2025; G09G 3/2029; G09G 3/2033; G09G 3/2037; G09G 3/204; G09G 3/3433; G09G 3/3406; G09G 2320/0276; G09G 2320/0626; G09G 2320/0633; G09G 2320/064; G09G 2320/0646; G09G 2320/0266; G09G 2310/0235; G09G 2340/06; G09G 2360/16

USPC ..... 345/87–89, 690–694

See application file for complete search history.

(56) References Cited

U.S. PATENT DOCUMENTS

| | | | |
|---|---|---|---|
| 7,248,244 | B2 | 7/2007 | Akiyama |
| 7,295,173 | B2 | 11/2007 | Itoh et al. |

(Continued)

FOREIGN PATENT DOCUMENTS

| | | | |
|---|---|---|---|
| JP | H1165521 | A | 3/1999 |

OTHER PUBLICATIONS

Lin, et al., "Color Breakup Suppression by Local Primary Desaturation in Field-Sequential Color LCDs," Journal of Display Technology, vol. 7, No. 2, Feb. 2011, pp. 55-61.

(Continued)

*Primary Examiner* — Rodney Amadiz

(74) *Attorney, Agent, or Firm* — Edward A. Gordon; Foley & Lardner LLP

(57) ABSTRACT

Systems, apparatus, and methods are disclosed herein for displaying images. One such apparatus includes an input, subfield derivation logic, subframe generation logic, dark subframe detection logic, and output logic. The input is configured to receive image data associated with an image frame. The subfield derivation logic is configured to derive at least one color subfield for the received image frame. The subframe generation logic is configured to generate a plurality of subframes for each of the at least one derived color subfields. The dark subframe detection logic is configured to identify dark subframes. The output logic is configured to, in response to identification of a dark subframe, suppress the outputting of the dark subframe and to modify a display parameter associated with at least one other subframe based on a timing value associated with the identified dark subframe.

44 Claims, 20 Drawing Sheets

(52) U.S. Cl.
CPC ..... *G09G 2310/0235* (2013.01); *G09G 2320/0266* (2013.01); *G09G 2320/064* (2013.01); *G09G 2320/0633* (2013.01); *G09G 2320/0646* (2013.01); *G09G 2330/021* (2013.01); *G09G 2340/06* (2013.01); *G09G 2360/16* (2013.01)

(56) References Cited

U.S. PATENT DOCUMENTS

| | | | |
|---|---|---|---|
| 7,301,549 | B2 | 11/2007 | Damera-Venkata |
| 7,391,390 | B2 | 6/2008 | Son |
| 8,228,350 | B2 | 7/2012 | Ng |
| 2004/0155891 | A1 | 8/2004 | Kang |
| 2005/0083250 | A1 | 4/2005 | De Greef |
| 2005/0083255 | A1 | 4/2005 | Son |
| 2006/0055629 | A1 | 3/2006 | Van Woudenberg |
| 2007/0064008 | A1 | 3/2007 | Childers |
| 2007/0211179 | A1 | 9/2007 | Hector et al. |
| 2008/0100232 | A1 | 5/2008 | Miguchi |

OTHER PUBLICATIONS

International Search Report and Written Opinion—PCT/US2014/021349—ISA/EPO—May 30, 2014.

DISPLAY APPARATUS CONFIGURED FOR SELECTIVE ILLUMINATION OF IMAGE SUBFRAMES

TECHNICAL FIELD

This disclosure relates to the field of displays, and in particular, to image formation processes used by displays.

DESCRIPTION OF THE RELATED TECHNOLOGY

Many display architectures rely in part on time division schemes to provide gray scale images. In such schemes, an image frame is broken down into a set of subframes, which are sequentially displayed to a viewer within the amount of time allocated to the display of an image frame. In general, the more subframes a display can display in the allocated time, the larger number of gray scale levels the display is able to generate. Additional subframes can also be used to help mitigate image artifacts such as dynamic false contouring (DFC). Displays that also employ field-sequential color (FSC) formation schemes, may generate and separately display even more subframes to account for each color primary employed by the display.

Using additional subframes, though, decreases the energy efficiency of a display. As the number of subframes a display employs to display a given image frame increases, the duty cycle of its light sources typically decreases. As such, to maintain sufficient brightness, the display must operate its light sources at higher intensities during the shorter durations in which they are on. Such higher intensity emission tends to be less power efficient. Moreover, displays must expend energy to load each subframe into the display. Thus many displays are forced to make a tradeoff between power efficiency and image quality. For mobile devices, where battery life is highly valued, this tradeoff often results in reduced image quality.

SUMMARY

The systems, methods and devices of the disclosure each have several innovative aspects, no single one of which is solely responsible for the desirable attributes disclosed herein.

One innovative aspect of the subject matter described in this disclosure can be implemented in an apparatus that includes an input, subfield derivation logic, subfield generation logic, dark subframe detection logic, and output logic. The input is configured to receive image data associated with an image frame.

The subfield derivation logic is configured to derive at least one color subfield for the received image frame. Each of the at least one color subfields identifies a color intensity value with respect to each of a plurality of light modulators in a display for the received image frame. In some implementations, the subfield derivation logic is configured to derive at least three color subfields for each received image frame.

The subframe generation logic is configured to generate a plurality of subframes for each of the at least one derived color subfields. Each generated subframe indicates the states of each of the plurality of light modulator in the display.

The dark subframe detection logic is configured to identify dark subframes. In some implementations, a dark subframe is a subframe that indicates that at least substantially all light modulators in the display are to be in a non-transmissive state. In some implementations, identifying dark subframes includes identifying subframes in which all light modulators in the display are to be in a non-transmissive state. In some other implementations, identifying dark subframes includes identifying subframes in which less than a threshold number of light modulators in the display are to be in a non-transmissive state.

The output logic is configured to control the timing of outputting the generated subframes to the plurality of light modulators and to control the timing of light source illumination signals output to a display light source for each of the output subframes. In some implementations, the display light source includes a backlight. In response to identification by the dark subframe detection logic of a dark subframe, the output logic is configured to suppress the outputting of the dark subframe and to modify a display parameter associated with at least one other subframe based on a timing value associated with the identified dark subframe. In some implementations, suppressing the display of the dark subframe comprises omitting loading the dark subframe into the plurality of light modulators In some implementations, the output logic is configured to modify the display parameter by increasing an amount of time for which the at least one other subframe is displayed based on the timing value. In some such implementations, the at least one other subframe includes all subframes generated for the received image frame other than those identified as being dark subframes. In some other implementations, modifying the display parameter also includes decreasing a light source intensity value associated with the display of the at least one other subframe based on the increase in the amount of time for which the at least one other subframe is displayed.

In some implementations, the modifying the display parameter includes allocating additional time to display at least one subframe of a color that is different than a color of the identified dark subframe. In some other implementations, modifying the display parameter includes allocating additional time to display at least one subframe of a plurality of colors and such additional time is allocated disproportionately to at least one subframes of a selected color.

In some implementations, modifying the display parameter includes allocating additional time to display at least one subframe of a selected color regardless of the color of the identified dark subframe. In some implementations, the selected color is green and allocating additional time may include increasing a number of times a green subframe is displayed. In some other implementations, the selected color is a composite color and allocating additional time may include includes increasing a number of times a composite color subframe is displayed or displaying a composite color subframe that would not otherwise have been displayed.

In some other implementations, modifying the display parameter includes increasing a number of times the at least one other subframe is displayed. In still some other implementations, modifying the display parameter includes decreasing a slew rate of a driver in association with addressing the display with the at least one other subframe. In some other implementations, modifying the display parameter includes displaying a subframe that would not otherwise have been displayed.

In some implementations, the apparatus further includes the display, a processor and a memory device. The processor can be configured to communicate with the display, the processor being configured to process image data. The memory device can be configured to communicate with the processor. In some implementations, the processor includes at least one of the subfield derivation logic, the subframe generation logic, the dark subframe detection logic and the output logic.

In some other implementations, the display includes control logic including at least one of the subfield derivation logic, the subframe generation logic, the dark subframe detection logic and the output logic. In some implementations, the control logic includes a microprocessor and an application specific integrated circuit (ASIC), and at least one of the subfield derivation logic, the subframe generation logic, the dark subframe detection logic and the output logic includes processor executable instructions configured for execution by the microprocessor.

In some implementations, the apparatus also includes a driver circuit configured to send at least one signal to the display. In such implementations, the processor can be configured to send at least a portion of the image data to the driver circuit. In some implementations, the apparatus can also include an image source module configured to send the image data to the processor. The image source module can be or include at least one of a receiver, transceiver, and transmitter. In some implementations, the apparatus also includes an input device configured to receive input data and to communicate the input data to the processor.

Another innovative aspect of the subject matter described in this disclosure can be implemented in an apparatus that includes an input, subfield derivation means, subframe generation means, dark subframe detection means, and output control means. The input is configured to receive image data associated with an image frame.

The subfield derivation means is for deriving at least one color subfield for the received image frame. Each of the at least one color subfields identifies a color intensity value with respect to each of a plurality of light modulators in a display for the received image frame.

The subframe generation means is for generating a plurality of subframes for each of the at least one derived color subfields. Each generated subframe indicates the states of each of the plurality of light modulator in the display.

The dark subframe detection means is for identifying dark subframes. In some implementations, a dark subframe is a subframe that indicates that at least substantially all light modulators in the display are to be in a non-transmissive state. In some implementations, identifying dark subframes includes identifying subframes in which all light modulators in the display are to be in a non-transmissive state. In some other implementations, identifying dark subframes includes identifying subframes in which less than a threshold number of light modulators in the display are to be in a non-transmissive state.

The output control means is for controlling the timing of outputting the generated subframes to the plurality of light modulators and for controlling the timing of light source illumination signals output to a display light source for each of the output subframes. In some implementations, the display light source includes a backlight. In response to identification by the dark subframe detection means of a dark subframe, the output control means is also for suppressing the outputting of the dark subframe and for modifying a display parameter associated with at least one other subframe based on a timing value associated with the identified dark subframe.

In some implementations, modifying the display parameter includes increasing an amount of time for which the at least one other subframe is displayed based on the timing value. In some such implementations, the at least one other subframe includes all subframes generated for the received image frame other than those identified as being dark subframes. In some implementations, modifying the display parameter also includes decreasing a light source intensity value associated with the display of the at least one other subframe based on the increase in the amount of time for which the at least one other subframe is displayed.

In some other implementations, modifying the display parameter can include one or more of increasing a number of times the at least one other subframe is displayed, displaying a subframe that would not otherwise have been displayed, and decreasing a slew rate of a driver in association with addressing the display with the at least one other subframe.

Another innovative aspect of the subject matter described in this disclosure can be implemented in a method of forming an image on a display. The method includes receiving image data associated with an image frame and deriving at least one color subfield for the received image frame. Each of the at least one color subfields identifies a color intensity value with respect to each of a plurality of light modulators in a display for the received image frame, The method also includes generating a plurality of subframes for each of the at least one derived color subfields. Each generated subframe indicates the states of each of the plurality of light modulator in the display. In addition, the method includes identifying dark subframes. Dark subframes are subframes that indicate that at least substantially all light modulators in the display are to be in a non-transmissive state. In some implementations, identifying dark subframes includes identifying subframes in which all light modulators in the display are to be in a non-transmissive state. In some other implementations, identifying dark subframes includes identifying subframes in which less than a threshold number of light modulators in the display are to be in a non-transmissive state. The timing of outputting the generated subframes to the plurality of light modulators is controlled. The timing of light source illumination signals to a display light source for each of the output subframes is also controlled. In some implementations, the display light source includes a backlight. In response to identification of a dark subframe, the outputting of the dark subframe is suppressed. In addition, a display parameter associated with at least one other subframe is modified based on a timing value associated with the identified dark subframe.

In various implementations, modifying the display parameter can include one or more of increasing an amount of time for which the at least one other subframe is displayed based on the timing value, decreasing a light source intensity value associated with the display of the at least one other subframe based on the increase in the amount of time for which the at least one other subframe is displayed, increasing a number of times the at least one other subframe is displayed, displaying a subframe that would not otherwise have been displayed and decreasing a slew rate of a driver in association with addressing the display with the at least one other subframe.

Details of one or more implementations of the subject matter described in this specification are set forth in the accompanying drawings and the description below. Although the examples provided in this summary are primarily described in terms of MEMS-based displays, the concepts provided herein may apply to other types of displays, such as liquid crystal displays (LCD), organic light emitting diode (OLED) displays, electrophoretic displays, and field emission displays, as well as to other non-display MEMS devices, such as MEMS microphones, sensors, and optical switches. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
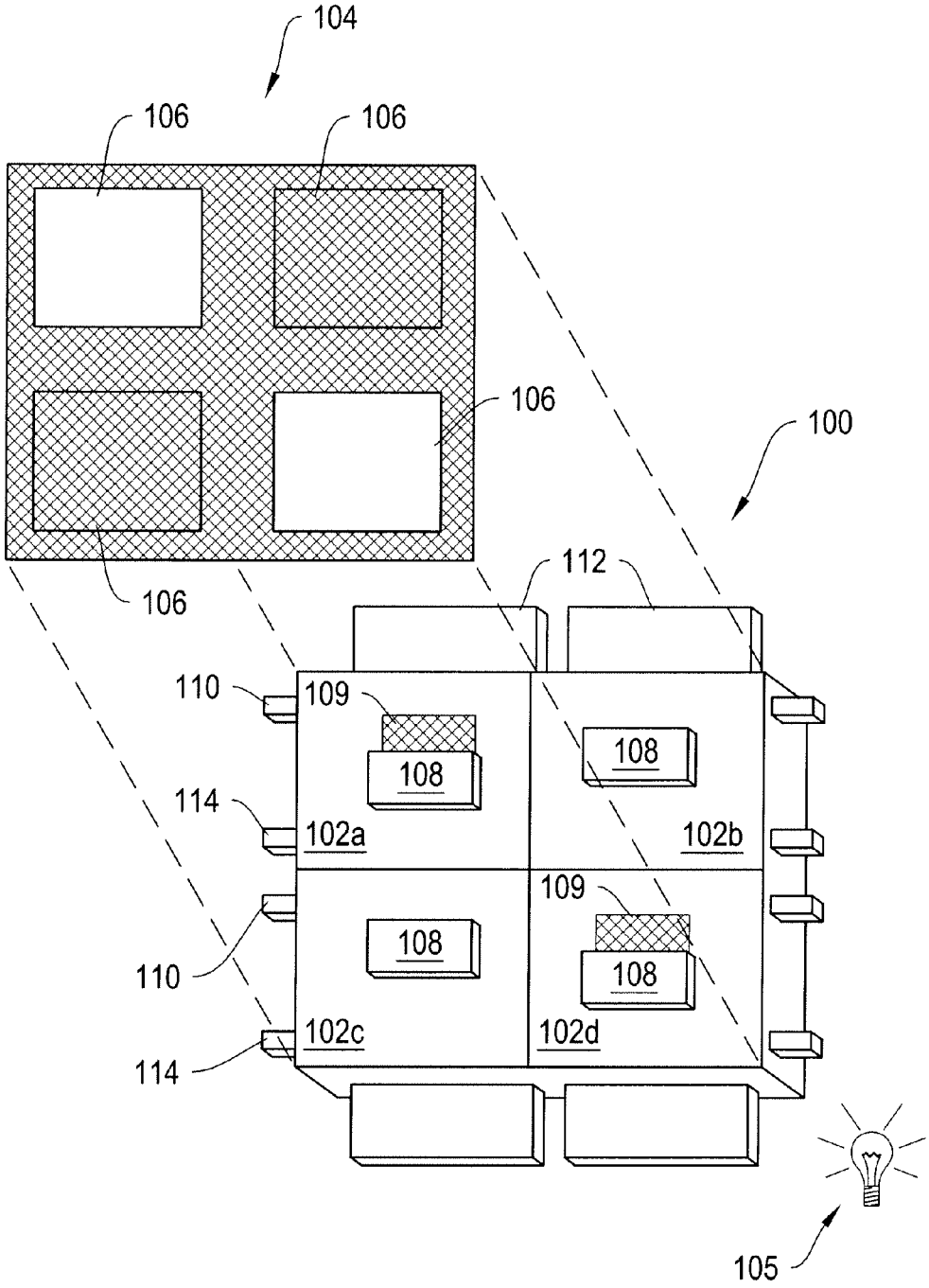
FIG. 1A shows a schematic diagram of an example direct-view microelectromechanical systems (MEMS) based display apparatus.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that can be configured to display an image, whether in motion (such as video) or stationary (such as still images), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, clocks, calculators, television monitors, flat panel displays, electronic reading devices (such as e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, as well as non-EMS applications), aesthetic structures (such as display of images on a piece of jewelry or clothing) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

Display energy efficiency can be improved while still providing improved image quality by identifying subframes that need not be displayed to faithfully reproduce an image frame, and then reallocating the time that would otherwise be used to display such subframes for other purposes. In particular, a display need not display a subframe in which all light modulators included in the display would be in non-transmissive states. Such subframes are referred to herein as "dark subframes." In some implementations, dark subframes can also include subframes in which substantially all light modulators in the display would in non-transmissive state. Failure to display such dark subframes does not substantially reduce image quality, and can in fact increase a display's contrast ratio.

The harvested time can be used in a number of ways. In some implementations, the harvested time can be used to increase the amount of time one or more subframes is illuminated by a display light source, such as a backlight or front light, thereby decreasing the intensity with which the light source needs to be illuminated. In some other implementations, the harvested time can be used to display subframes more than once during the display time allocated for an image frame. In some other implementations, the harvested time can be used to display subframes that would not otherwise have been displayed at all. In still some other implementations, the time can be used to allow display drivers to operate using lower slew rates to reduce power consumption.

Particular implementations of the subject matter described in this disclosure can be implemented to realize one or more of the following potential advantages. Skipping the loading of dark subframes into a display and illuminating such dark subframes improves the energy efficiency and image quality of a display. Additional energy efficiency and/or image quality gains are available by harvesting the time that would otherwise be spent in loading and illuminating the dark subframes, and using such time to display the remaining subframes, or in some implementations to display additional subframes. For example, reallocating harvested time to display other subframes for longer durations allows a display light source to operate at a lower intensity, at a more efficient point on its power curve. Using harvested time to display a higher weighted subframe multiple times in the time allocated for displaying an image frame can reduce flicker artifacts, and in some cases color break up (CBU) artifacts, too. Allocating harvested time to lower weighted subframes that would not otherwise have been displayed at all enables a display to provide greater granularity in the colors it generates for an image frame. Allocating additional time for data drivers to address the display for one or more subframes at a lower slew rate, can provide for reduced driver power consumption.

FIG. 1A shows a schematic diagram of an example direct-view MEMS-based display apparatus 100. The display apparatus 100 includes a plurality of light modulators 102*a*-102*d* (generally "light modulators 102") arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide luminance level in an image 104. With respect to an image, a "pixel" corresponds to the smallest picture element defined by the resolution of image. With respect to structural components of the display apparatus 100, the term "pixel" refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the user sees the image by looking directly at the display apparatus, which contains the light modulators and optionally a backlight or front light for enhancing brightness and/or contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a lightguide or "backlight" so that each pixel can be uniformly illuminated. Transmissive direct-view displays are often built onto transparent or glass substrates to facilitate a sandwich assembly arrangement where one substrate, containing the light modulators, is positioned directly on top of the backlight.

Each light modulator 102 can include a shutter 108 and an aperture 109. To illuminate a pixel 106 in the image 104, the shutter 108 is positioned such that it allows light to pass through the aperture 109 towards a viewer. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix connected to the substrate and to the light modulators for controlling the movement of the shutters. The control matrix includes a series of electrical interconnects (such as interconnects 110, 112 and 114), including at least one write-enable interconnect 110 (also referred to as a "scan-line interconnect") per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the "write-enabling voltage, $V_{WE}$"), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, such as transistors or other non-linear circuit elements that control the application of separate actuation voltages, which are typically higher in magnitude than the data voltages, to the light modulators 102. The application of these actuation voltages then results in the electrostatic driven movement of the shutters 108.

Figure 1B:
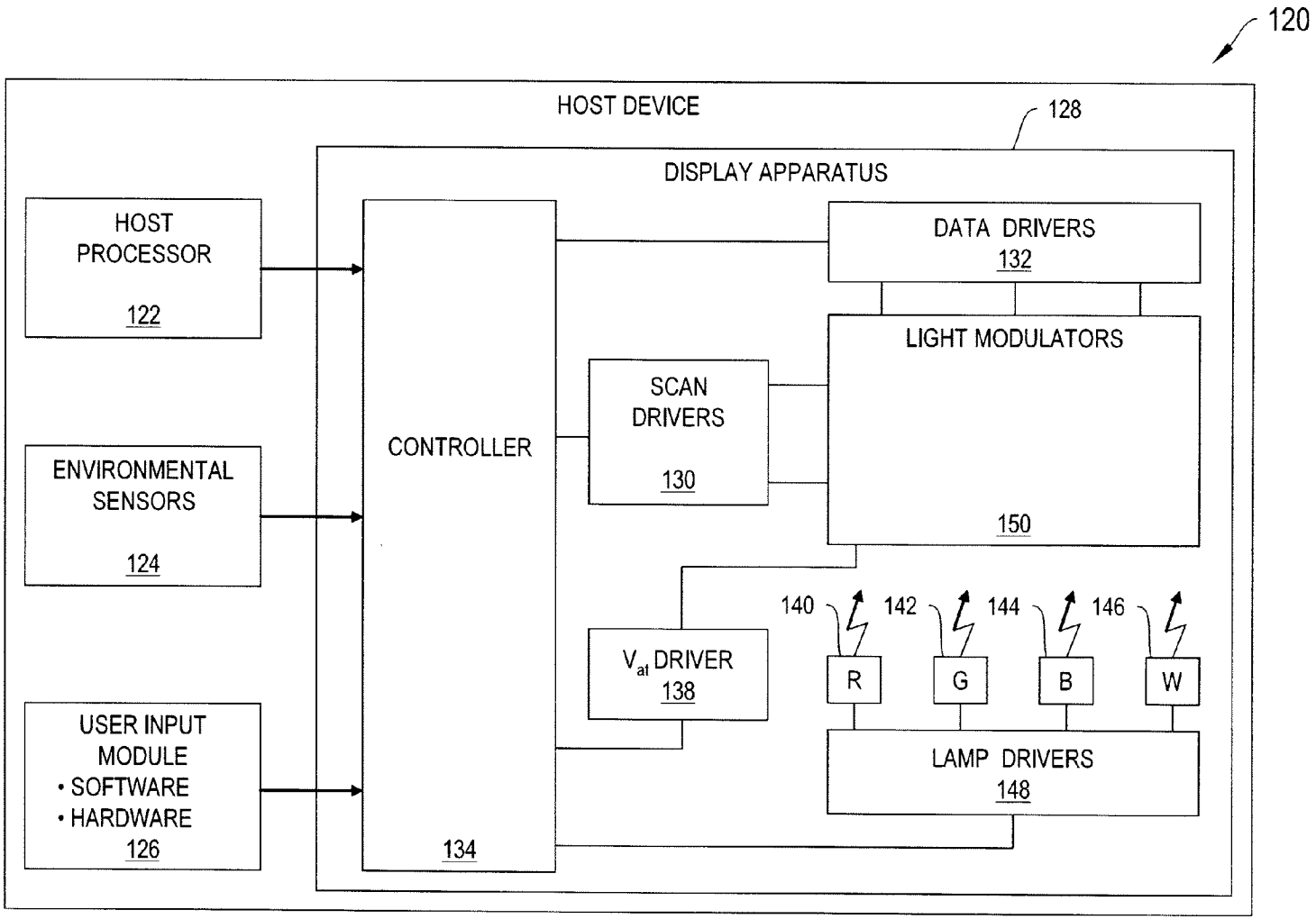
FIG. 1B shows a block diagram of an example host device.

FIG. 1B shows a block diagram of an example host device 120 (i.e., cell phone, smart phone, PDA, MP3 player, tablet, e-reader, netbook, notebook, etc.). The host device 120 includes a display apparatus 128, a host processor 122, environmental sensors 124, a user input module 126, and a power source.

The display apparatus 128 includes a plurality of scan drivers 130 (also referred to as "write enabling voltage sources"), a plurality of data drivers 132 (also referred to as "data voltage sources"), a controller 134, common drivers 138, lamps 140-146, lamp drivers 148 and an array 150 of display elements, such as the light modulators 102 shown in FIG. 1A. The scan drivers 130 apply write enabling voltages to scan-line interconnects 110. The data drivers 132 apply data voltages to the data interconnects 112.

In some implementations of the display apparatus, the data drivers 132 are configured to provide analog data voltages to the array 150 of display elements, especially where the luminance level of the image 104 is to be derived in analog fashion. In analog operation, the light modulators 102 are designed such that when a range of intermediate voltages is applied through the data interconnects 112, there results a range of intermediate open states in the shutters 108 and therefore a range of intermediate illumination states or luminance levels in the image 104. In other cases, the data drivers 132 are configured to apply only a reduced set of 2, 3 or 4 digital voltage levels to the data interconnects 112. These voltage levels are designed to set, in digital fashion, an open state, a closed state, or other discrete state to each of the shutters 108.

The scan drivers 130 and the data drivers 132 are connected to a digital controller circuit 134 (also referred to as the "controller 134"). The controller sends data to the data drivers 132 in a mostly serial fashion, organized in predetermined sequences grouped by rows and by image frames. The data drivers 132 can include series to parallel data converters, level shifting, and for some applications digital to analog voltage converters.

The display apparatus optionally includes a set of common drivers 138, also referred to as common voltage sources. In some implementations, the common drivers 138 provide a DC common potential to all display elements within the array 150 of display elements, for instance by supplying voltage to a series of common interconnects 114. In some other implementations, the common drivers 138, following commands from the controller 134, issue voltage pulses or signals to the array 150 of display elements, for instance global actuation pulses which are capable of driving and/or initiating simultaneous actuation of all display elements in multiple rows and columns of the array 150.

All of the drivers (such as scan drivers 130, data drivers 132 and common drivers 138) for different display functions are time-synchronized by the controller 134. Timing commands from the controller coordinate the illumination of red, green and blue and white lamps (140, 142, 144 and 146 respectively) via lamp drivers 148, the write-enabling and sequencing of specific rows within the array 150 of display elements, the output of voltages from the data drivers 132, and the output of voltages that provide for display element actuation. In some implementations, the lamps are light emitting diodes (LEDs).

The controller 134 determines the sequencing or addressing scheme by which each of the shutters 108 can be re-set to the illumination levels appropriate to a new image 104. New images 104 can be set at periodic intervals. For instance, for video displays, the color images 104 or frames of video are refreshed at frequencies ranging from 10 to 300 Hertz (Hz). In some implementations the setting of an image frame to the array 150 is synchronized with the illumination of the lamps 140, 142, 144 and 146 such that alternate image frames are illuminated with an alternating series of colors, such as red, green, and blue. The image frames for each respective color is referred to as a color subframe. In this method, referred to as the field sequential color method, if the color subframes are alternated at frequencies in excess of 20 Hz, the human brain will average the alternating frame images into the perception of an image having a broad and continuous range of colors. In alternate implementations, four or more lamps with primary colors can be employed in display apparatus 100, employing primaries other than red, green, and blue.

In some implementations, where the display apparatus 100 is designed for the digital switching of shutters 108 between open and closed states, the controller 134 forms an image by the method of time division gray scale, as previously described. In some other implementations, the display apparatus 100 can provide gray scale through the use of multiple shutters 108 per pixel.

In some implementations, the data for an image state 104 is loaded by the controller 134 to the display element array 150 by a sequential addressing of individual rows, also referred to as scan lines. For each row or scan line in the sequence, the scan driver 130 applies a write-enable voltage to the write enable interconnect 110 for that row of the array 150, and subsequently the data driver 132 supplies data voltages, corresponding to desired shutter states, for each column in the selected row. This process repeats until data has been loaded for all rows in the array 150. In some implementations, the sequence of selected rows for data loading is linear, proceeding from top to bottom in the array 150. In some other implementations, the sequence of selected rows is pseudo-randomized, in order to minimize visual artifacts. And in some other implementations the sequencing is organized by blocks, where, for a block, the data for only a certain fraction of the image state 104 is loaded to the array 150, for instance by addressing only every $5^{th}$ row of the array 150 in sequence.

In some implementations, the process for loading image data to the array 150 is separated in time from the process of actuating the display elements in the array 150. In these implementations, the display element array 150 may include data memory elements for each display element in the array 150 and the control matrix may include a global actuation interconnect for carrying trigger signals, from common driver 138, to initiate simultaneous actuation of shutters 108 according to data stored in the memory elements.

In alternative implementations, the array 150 of display elements and the control matrix that controls the display elements may be arranged in configurations other than rectangular rows and columns. For example, the display elements can be arranged in hexagonal arrays or curvilinear rows and columns. In general, as used herein, the term scan-line shall refer to any plurality of display elements that share a write-enabling interconnect.

The host processor 122 generally controls the operations of the host. For example, the host processor 122 may be a general or special purpose processor for controlling a portable electronic device. With respect to the display apparatus 128, included within the host device 120, the host processor 122 outputs image data as well as additional data about the host. Such information may include data from environmental sensors, such as ambient light or temperature; information about the host, including, for example, an operating mode of the host or the amount of power remaining in the host's power source; information about the content of the image data; information about the type of image data; and/or instructions for display apparatus for use in selecting an imaging mode.

The user input module 126 conveys the personal preferences of the user to the controller 134, either directly, or via the host processor 122. In some implementations, the user input module 126 is controlled by software in which the user programs personal preferences such as "deeper color," "better contrast," "lower power," "increased brightness," "sports," "live action," or "animation." In some other implementations, these preferences are input to the host using hardware, such as a switch or dial. The plurality of data inputs to the controller 134 direct the controller to provide data to the various drivers 130, 132, 138 and 148 which correspond to optimal imaging characteristics.

An environmental sensor module 124 also can be included as part of the host device 120. The environmental sensor module 124 receives data about the ambient environment, such as temperature and or ambient lighting conditions. The sensor module 124 can be programmed to distinguish whether the device is operating in an indoor or office environment versus an outdoor environment in bright daylight versus an outdoor environment at nighttime. The sensor module 124 communicates this information to the display controller 134, so that the controller 134 can optimize the viewing conditions in response to the ambient environment.

Figure 2A:
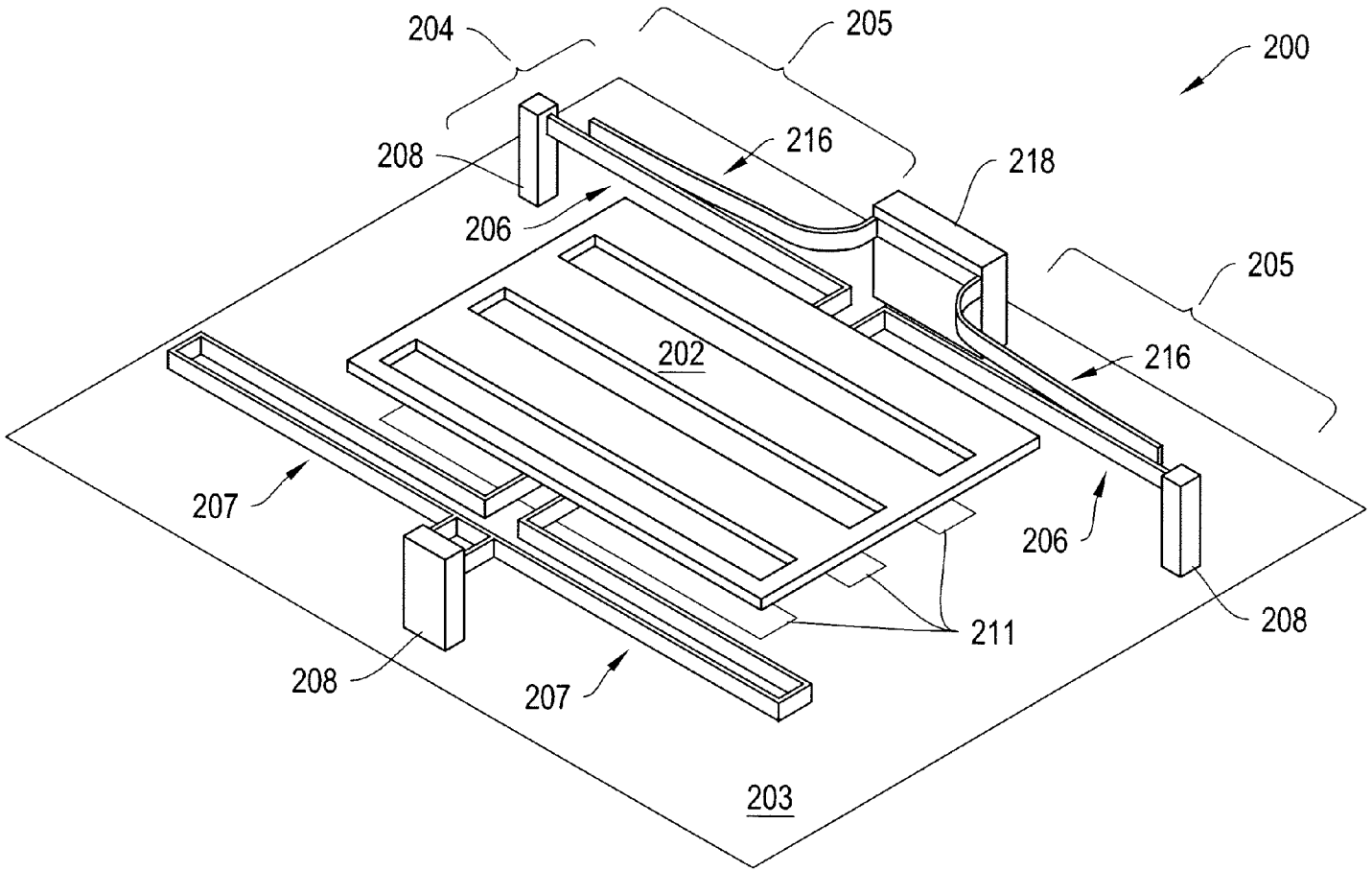
FIG. 2A shows a perspective view of an example shutter-based light modulator.

FIG. 2A shows a perspective view of an example shutter-based light modulator 200. The shutter-based light modulator 200 is suitable for incorporation into the direct-view MEMS-based display apparatus 100 of FIG. 1A. The light modulator 200 includes a shutter 202 coupled to an actuator 204. The actuator 204 can be formed from two separate compliant electrode beam actuators 205 (the "actuators 205"). The shutter 202 couples on one side to the actuators 205. The actuators 205 move the shutter 202 transversely over a surface 203 in a plane of motion which is substantially parallel to the surface 203. The opposite side of the shutter 202 couples to a spring 207 which provides a restoring force opposing the forces exerted by the actuator 204.

Each actuator 205 includes a compliant load beam 206 connecting the shutter 202 to a load anchor 208. The load anchors 208 along with the compliant load beams 206 serve as mechanical supports, keeping the shutter 202 suspended proximate to the surface 203. The surface 203 includes one or more aperture holes 211 for admitting the passage of light. The load anchors 208 physically connect the compliant load beams 206 and the shutter 202 to the surface 203 and electrically connect the load beams 206 to a bias voltage, in some instances, ground.

If the substrate is opaque, such as silicon, then aperture holes 211 are formed in the substrate by etching an array of holes through the substrate 204. If the substrate 204 is transparent, such as glass or plastic, then the aperture holes 211 are formed in a layer of light-blocking material deposited on the substrate 203. The aperture holes 211 can be generally circular, elliptical, polygonal, serpentine, or irregular in shape.

Each actuator 205 also includes a compliant drive beam 216 positioned adjacent to each load beam 206. The drive beams 216 couple at one end to a drive beam anchor 218 shared between the drive beams 216. The other end of each drive beam 216 is free to move. Each drive beam 216 is curved such that it is closest to the load beam 206 near the free end of the drive beam 216 and the anchored end of the load beam 206.

In operation, a display apparatus incorporating the light modulator 200 applies an electric potential to the drive beams 216 via the drive beam anchor 218. A second electric potential may be applied to the load beams 206. The resulting potential difference between the drive beams 216 and the load beams 206 pulls the free ends of the drive beams 216 towards the anchored ends of the load beams 206, and pulls the shutter ends of the load beams 206 toward the anchored ends of the drive beams 216, thereby driving the shutter 202 transversely toward the drive anchor 218. The compliant members 206 act as springs, such that when the voltage across the beams 206 and 216 potential is removed, the load beams 206 push the shutter 202 back into its initial position, releasing the stress stored in the load beams 206.

A light modulator, such as the light modulator 200, incorporates a passive restoring force, such as a spring, for returning a shutter to its rest position after voltages have been removed. Other shutter assemblies can incorporate a dual set of "open" and "closed" actuators and a separate set of "open" and "closed" electrodes for moving the shutter into either an open or a closed state.

There are a variety of methods by which an array of shutters and apertures can be controlled via a control matrix to produce images, in many cases moving images, with appropriate luminance levels. In some cases, control is accomplished by means of a passive matrix array of row and column interconnects connected to driver circuits on the periphery of the display. In other cases it is appropriate to include switching and/or data storage elements within each pixel of the array (the so-called active matrix) to improve the speed, the luminance level and/or the power dissipation performance of the display.

Figure 2B:
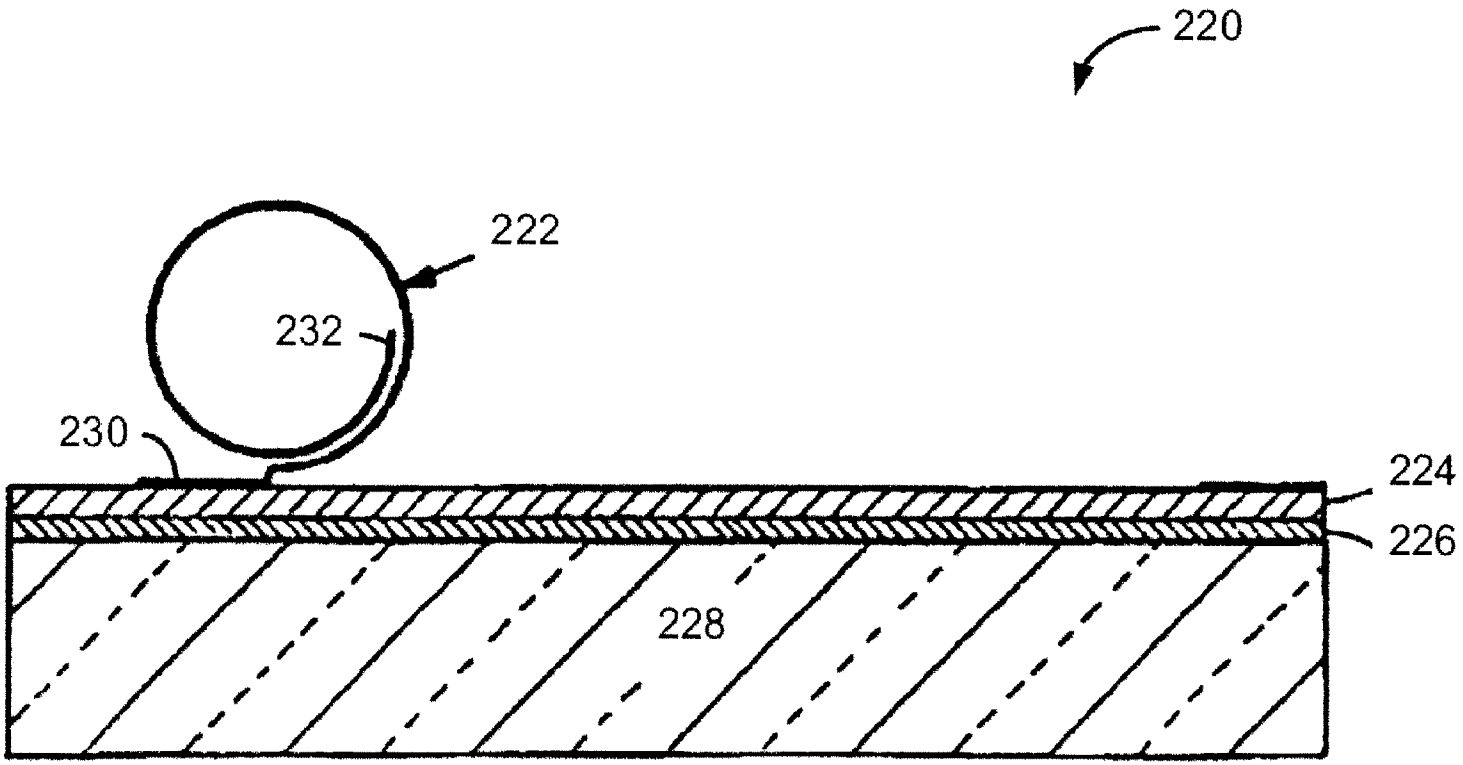
FIG. 2B shows a cross sectional view of an example rolling actuator shutter-based light modulator.

The display apparatus 100, in alternative implementations, includes display elements other than transverse shutter-based light modulators, such as the shutter assembly 200 described above. For example, FIG. 2B shows a cross sectional view of an example rolling actuator shutter-based light modulator 220. The rolling actuator shutter-based light modulator 220 is suitable for incorporation into an alternative implementation of the MEMS-based display apparatus 100 of FIG. 1A. A rolling actuator-based light modulator includes a movable electrode disposed opposite a fixed electrode and biased to move in a particular direction to function as a shutter upon application of an electric field. In some implementations, the light modulator 220 includes a planar electrode 226 disposed between a substrate 228 and an insulating layer 224 and a movable electrode 222 having a fixed end 230 attached to the insulating layer 224. In the absence of any applied voltage, a movable end 232 of the movable electrode 222 is free to roll towards the fixed end 230 to produce a rolled state. Application of a voltage between the electrodes 222 and 226 causes the movable electrode 222 to unroll and lie flat against the insulating layer 224, whereby it acts as a shutter that blocks light traveling through the substrate 228. The movable electrode 222 returns to the rolled state by means of an elastic restoring force after the voltage is removed. The bias towards a rolled state may be achieved by manufacturing the movable electrode 222 to include an anisotropic stress state.

Figure 2C:
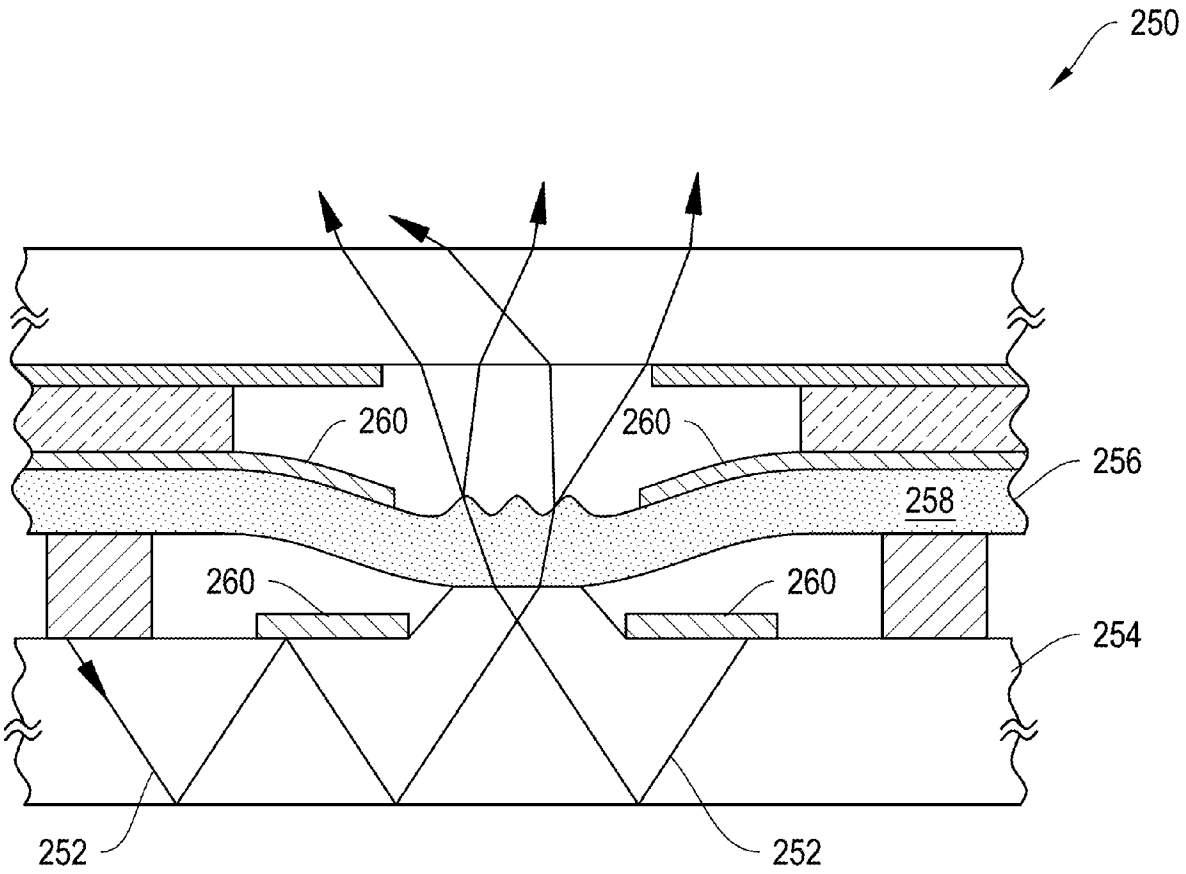
FIG. 2C shows a cross sectional view of an example non shutter-based MEMS light modulator.

FIG. 2C shows a cross sectional view of an example non shutter-based MEMS light modulator 250. The light tap modulator 250 is suitable for incorporation into an alternative implementation of the MEMS-based display apparatus 100 of FIG. 1A. A light tap works according to a principle of frustrated total internal reflection (TIR). That is, light 252 is introduced into a light guide 254, in which, without interference, light 252 is, for the most part, unable to escape the light guide 254 through its front or rear surfaces due to TIR. The light tap 250 includes a tap element 256 that has a sufficiently high index of refraction that, in response to the tap element 256 contacting the light guide 254, the light 252 impinging on the surface of the light guide 254 adjacent the tap element 256 escapes the light guide 254 through the tap element 256 towards a viewer, thereby contributing to the formation of an image.

In some implementations, the tap element 256 is formed as part of a beam 258 of flexible, transparent material. Electrodes 260 coat portions of one side of the beam 258. Opposing electrodes 262 are disposed on the light guide 254. By applying a voltage across the electrodes 260 and 262, the position of the tap element 256 relative to the light guide 254 can be controlled to selectively extract light 252 from the light guide 254.

Figure 2D:
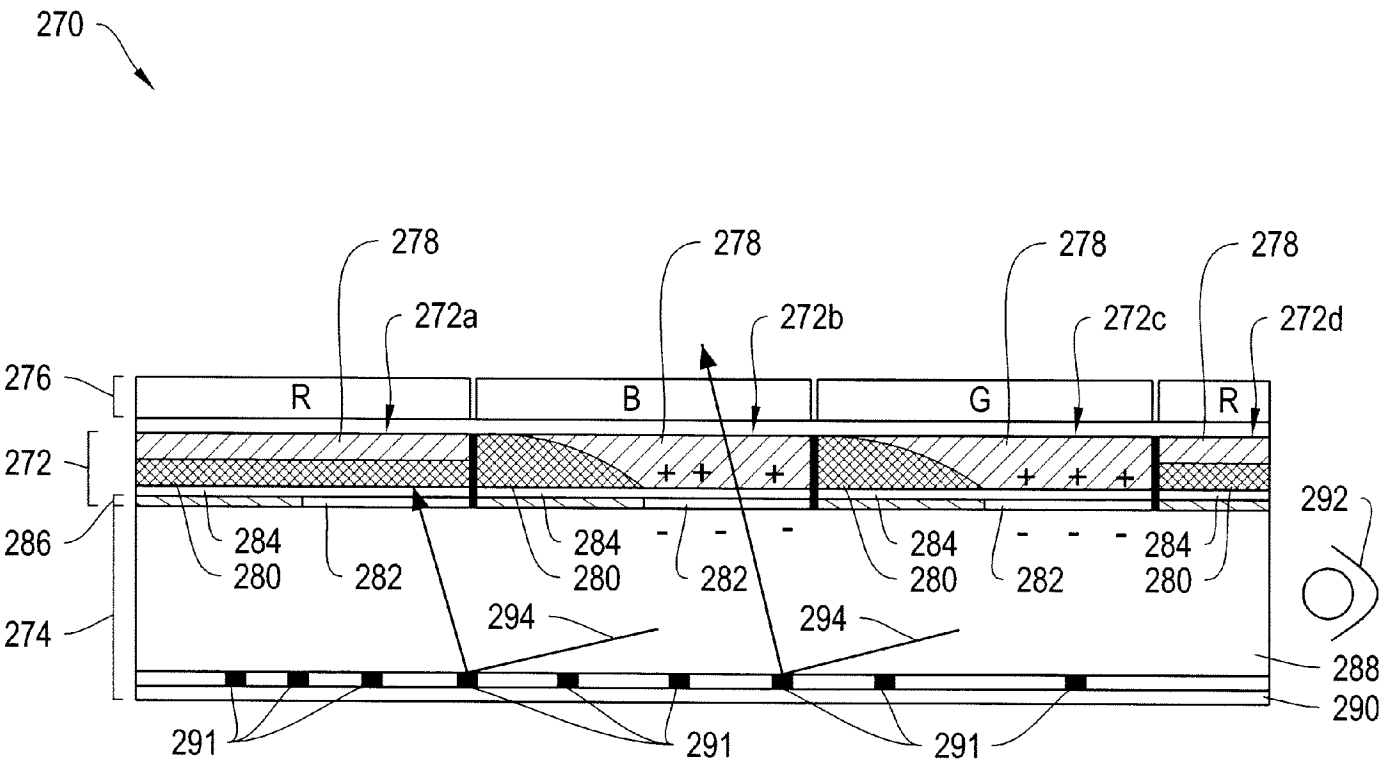
FIG. 2D shows a cross sectional view of an example electrowetting-based light modulation array.

FIG. 2D shows a cross sectional view of an example electrowetting-based light modulation array 270. The electrowetting-based light modulation array 270 is suitable for incorporation into an alternative implementation of the MEMS-based display apparatus 100 of FIG. 1A. The light modulation array 270 includes a plurality of electrowetting-based light modulation cells 272*a-d* (generally "cells 272") formed on an optical cavity 274. The light modulation array 270 also includes a set of color filters 276 corresponding to the cells 272.

Each cell 272 includes a layer of water (or other transparent conductive or polar fluid) 278, a layer of light absorbing oil 280, a transparent electrode 282 (made, for example, from indium-tin oxide (ITO)) and an insulating layer 284 positioned between the layer of light absorbing oil 280 and the transparent electrode 282. In the implementation described herein, the electrode takes up a portion of a rear surface of a cell 272.

The remainder of the rear surface of a cell 272 is formed from a reflective aperture layer 286 that forms the front surface of the optical cavity 274. The reflective aperture layer 286 is formed from a reflective material, such as a reflective metal or a stack of thin films forming a dielectric mirror. For each cell 272, an aperture is formed in the reflective aperture layer 286 to allow light to pass through. The electrode 282 for the cell is deposited in the aperture and over the material forming the reflective aperture layer 286, separated by another dielectric layer.

The remainder of the optical cavity 274 includes a light guide 288 positioned proximate the reflective aperture layer 286, and a second reflective layer 290 on a side of the light guide 288 opposite the reflective aperture layer 286. A series of light redirectors 291 are formed on the rear surface of the light guide, proximate the second reflective layer. The light redirectors 291 may be either diffuse or specular reflectors. One or more light sources 292, such as LEDs, inject light 294 into the light guide 288.

In an alternative implementation, an additional transparent substrate (not shown) is positioned between the light guide 288 and the light modulation array 270. In this implementation, the reflective aperture layer 286 is formed on the additional transparent substrate instead of on the surface of the light guide 288.

In operation, application of a voltage to the electrode 282 of a cell (for example, cell 272*b* or 272*c*) causes the light absorbing oil 280 in the cell to collect in one portion of the cell 272. As a result, the light absorbing oil 280 no longer obstructs the passage of light through the aperture formed in the reflective aperture layer 286 (see, for example, cells 272*b* and 272*c*). Light escaping the backlight at the aperture is then able to escape through the cell and through a corresponding color filter (for example, red, green or blue) in the set of color filters 276 to form a color pixel in an image. When the electrode 282 is grounded, the light absorbing oil 280 covers the aperture in the reflective aperture layer 286, absorbing any light 294 attempting to pass through it.

The area under which oil 280 collects when a voltage is applied to the cell 272 constitutes wasted space in relation to forming an image. This area is non-transmissive, whether a voltage is applied or not. Therefore, without the inclusion of the reflective portions of reflective apertures layer 286, this area absorbs light that otherwise could be used to contribute to the formation of an image. However, with the inclusion of the reflective aperture layer 286, this light, which otherwise would have been absorbed, is reflected back into the light guide 290 for future escape through a different aperture. The electrowetting-based light modulation array 270 is not the only example of a non-shutter-based MEMS modulator suitable for inclusion in the display apparatus described herein. Other forms of non-shutter-based MEMS modulators could likewise be controlled by various ones of the controller functions described herein without departing from the scope of this disclosure.

Figure 3A:
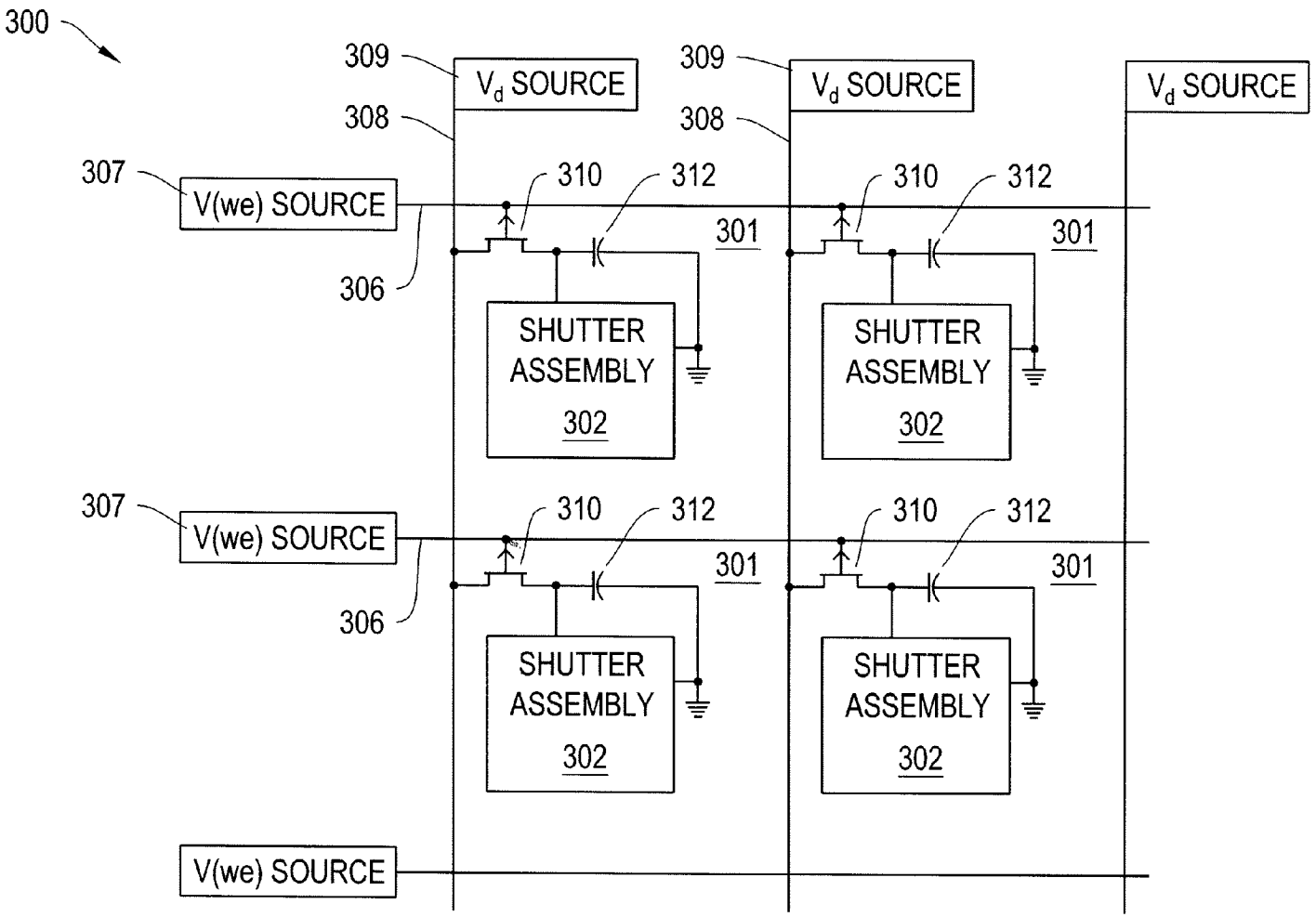
FIG. 3A shows a schematic diagram of an example control matrix.
Figure 3B:
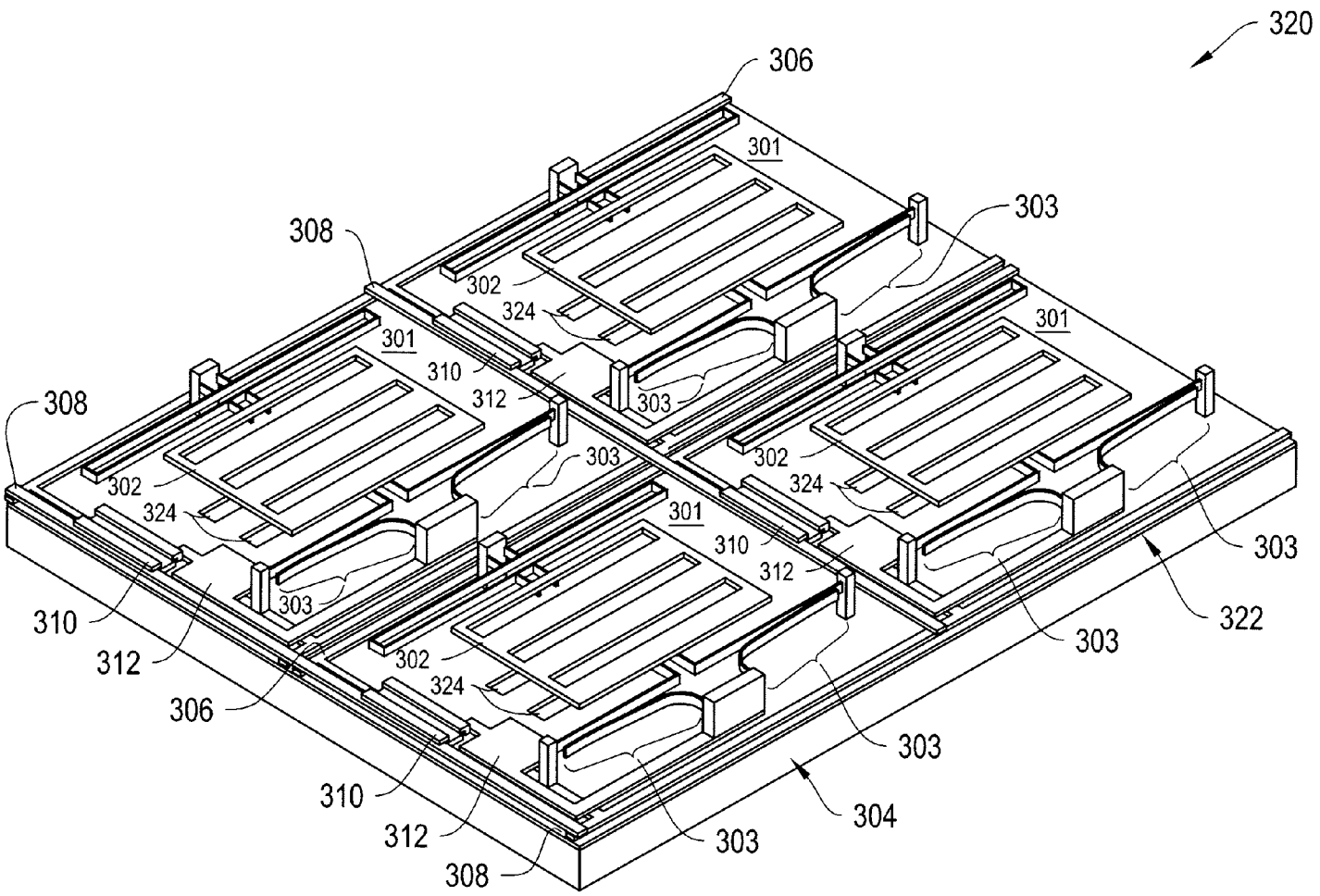
FIG. 3B shows a perspective view of an example array of shutter-based light modulators connected to the control matrix of FIG. 3A.

FIG. 3A shows a schematic diagram of an example control matrix 300. The control matrix 300 is suitable for controlling the light modulators incorporated into the MEMS-based display apparatus 100 of FIG. 1A. FIG. 3B shows a perspective view of an example array 320 of shutter-based light modulators connected to the control matrix 300 of FIG. 3A. The control matrix 300 may address an array of pixels 320 (the "array 320"). Each pixel 301 can include an elastic shutter assembly 302, such as the shutter assembly 200 of FIG. 2A, controlled by an actuator 303. Each pixel also can include an aperture layer 322 that includes apertures 324.

The control matrix 300 is fabricated as a diffused or thin-film-deposited electrical circuit on the surface of a substrate 304 on which the shutter assemblies 302 are formed. The control matrix 300 includes a scan-line interconnect 306 for each row of pixels 301 in the control matrix 300 and a data-interconnect 308 for each column of pixels 301 in the control matrix 300. Each scan-line interconnect 306 electrically connects a write-enabling voltage source 307 to the pixels 301 in a corresponding row of pixels 301. Each data interconnect 308 electrically connects a data voltage source 309 ("$V_d$ source") to the pixels 301 in a corresponding column of pixels. In the control matrix 300, the $V_d$ source 309 provides the majority of the energy to be used for actuation of the shutter assemblies 302. Thus, the data voltage source, $V_d$ source 309, also serves as an actuation voltage source.

Referring to FIGS. 3A and 3B, for each pixel 301 or for each shutter assembly 302 in the array of pixels 320, the control matrix 300 includes a transistor 310 and a capacitor 312. The gate of each transistor 310 is electrically connected to the scan-line interconnect 306 of the row in the array 320 in which the pixel 301 is located. The source of each transistor 310 is electrically connected to its corresponding data interconnect 308. The actuators 303 of each shutter assembly 302 include two electrodes. The drain of each transistor 310 is electrically connected in parallel to one electrode of the corresponding capacitor 312 and to one of the electrodes of the corresponding actuator 303. The other electrode of the capacitor 312 and the other electrode of the actuator 303 in shutter assembly 302 are connected to a common or ground potential. In alternate implementations, the transistors 310 can be replaced with semiconductor diodes and or metal-insulator-metal sandwich type switching elements.

In operation, to form an image, the control matrix 300 write-enables each row in the array 320 in a sequence by applying $V_{we}$ to each scan-line interconnect 306 in turn. For a write-enabled row, the application of $V_{we}$ to the gates of the transistors 310 of the pixels 301 in the row allows the flow of current through the data interconnects 308 through the transistors 310 to apply a potential to the actuator 303 of the shutter assembly 302. While the row is write-enabled, data voltages $V_d$ are selectively applied to the data interconnects 308. In implementations providing analog gray scale, the data voltage applied to each data interconnect 308 is varied in relation to the desired brightness of the pixel 301 located at the intersection of the write-enabled scan-line interconnect 306 and the data interconnect 308. In implementations providing digital control schemes, the data voltage is selected to be either a relatively low magnitude voltage (i.e., a voltage near ground) or to meet or exceed $V_{at}$ (the actuation threshold voltage). In response to the application of $V_{at}$ to a data interconnect 308, the actuator 303 in the corresponding shutter assembly actuates, opening the shutter in that shutter assembly 302. The voltage applied to the data interconnect 308 remains stored in the capacitor 312 of the pixel 301 even after the control matrix 300 ceases to apply $V_{we}$ to a row. Therefore, the voltage $V_{we}$ does not have to wait and hold on a row for times long enough for the shutter assembly 302 to actuate; such actuation can proceed after the write-enabling voltage has been removed from the row. The capacitors 312 also function as memory elements within the array 320, storing actuation instructions for the illumination of an image frame.

The pixels 301 as well as the control matrix 300 of the array 320 are formed on a substrate 304. The array 320 includes an aperture layer 322, disposed on the substrate 304, which includes a set of apertures 324 for respective pixels 301 in the array 320. The apertures 324 are aligned with the shutter assemblies 302 in each pixel. In some implementations, the substrate 304 is made of a transparent material, such as glass or plastic. In some other implementations, the substrate 304 is made of an opaque material, but in which holes are etched to form the apertures 324.

The shutter assembly 302 together with the actuator 303 can be made bi-stable. That is, the shutters can exist in at least two equilibrium positions (such as open or closed) with little or no power required to hold them in either position. More particularly, the shutter assembly 302 can be mechanically bi-stable. Once the shutter of the shutter assembly 302 is set in position, no electrical energy or holding voltage is required to maintain that position. The mechanical stresses on the physical elements of the shutter assembly 302 can hold the shutter in place.

The shutter assembly 302 together with the actuator 303 also can be made electrically bi-stable. In an electrically bi-stable shutter assembly, there exists a range of voltages below the actuation voltage of the shutter assembly, which if applied to a closed actuator (with the shutter being either open or closed), holds the actuator closed and the shutter in position, even if an opposing force is exerted on the shutter. The opposing force may be exerted by a spring such as the spring 207 in the shutter-based light modulator 200 depicted in FIG. 2A, or the opposing force may be exerted by an opposing actuator, such as an "open" or "closed" actuator.

The light modulator array 320 is depicted as having a single MEMS light modulator per pixel. Other implementations are possible in which multiple MEMS light modulators are provided in each pixel, thereby providing the possibility of more than just binary "on' or "off" optical states in each pixel. Certain forms of coded area division gray scale are possible where multiple MEMS light modulators in the pixel are provided, and where apertures 324, which are associated with each of the light modulators, have unequal areas.

In some other implementations, the roller-based light modulator 220, the light tap 250, or the electrowetting-based light modulation array 270, as well as other MEMS-based light modulators, can be substituted for the shutter assembly 302 within the light modulator array 320.

Figure 4B:
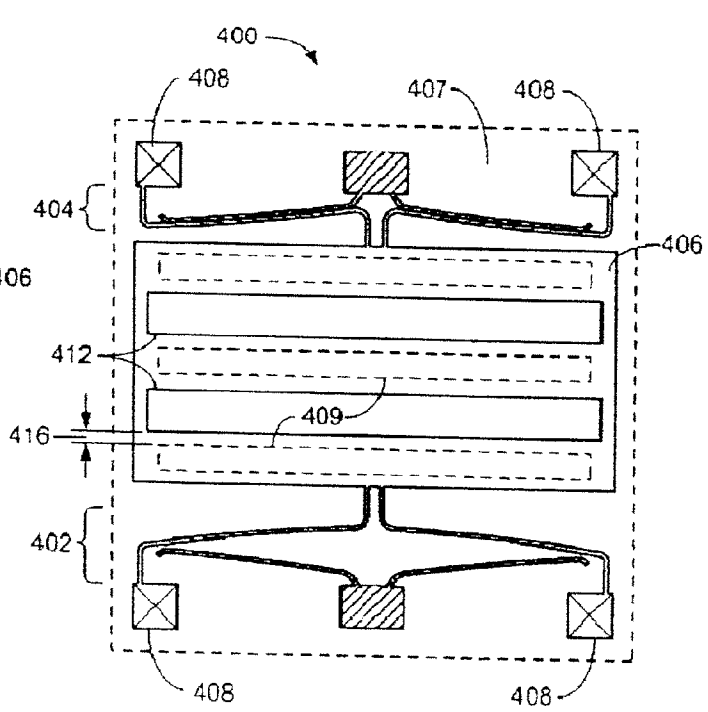
FIGS. 4A and 4B show views of an example dual actuator shutter assembly.
Figure 4A:
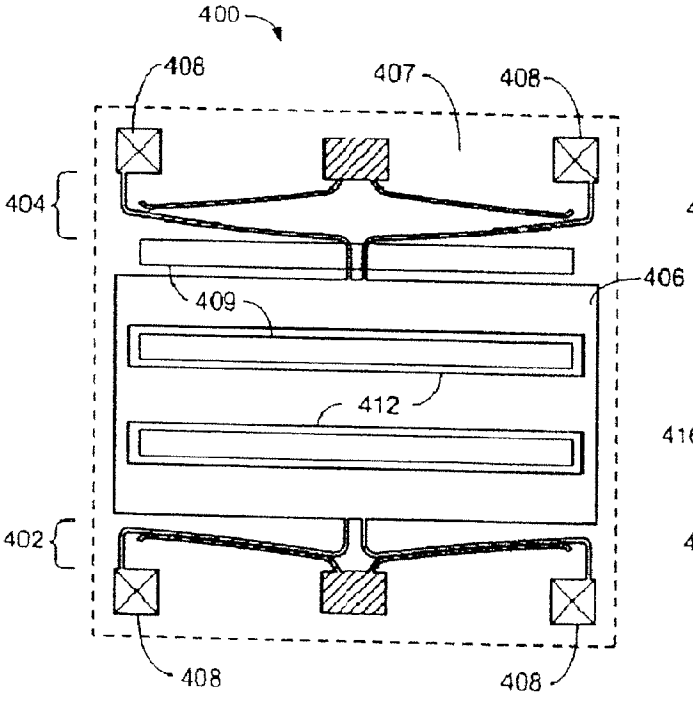

FIGS. 4A and 4B show views of an example dual actuator shutter assembly 400. The dual actuator shutter assembly 400, as depicted in FIG. 4A, is in an open state. FIG. 4B shows the dual actuator shutter assembly 400 in a closed state. In contrast to the shutter assembly 200, the shutter assembly 400 includes actuators 402 and 404 on either side of a shutter 406. Each actuator 402 and 404 is independently controlled. A first actuator, a shutter-open actuator 402, serves to open the shutter 406. A second opposing actuator, the shutter-close actuator 404, serves to close the shutter 406. Both of the actuators 402 and 404 are compliant beam electrode actuators. The actuators 402 and 404 open and close the shutter 406 by driving the shutter 406 substantially in a plane parallel to an aperture layer 407 over which the shutter is suspended. The shutter 406 is suspended a short distance over the aperture layer 407 by anchors 408 attached to the actuators 402 and 404. The inclusion of supports attached to both ends of the shutter 406 along its axis of movement reduces out of plane motion of the shutter 406 and confines the motion substantially to a plane parallel to the substrate. By analogy to the control matrix 300 of FIG. 3A, a control matrix suitable for use with the shutter assembly 400 might include one transistor and one capacitor for each of the opposing shutter-open and shutter-close actuators 402 and 404.

The shutter 406 includes two shutter apertures 412 through which light can pass. The aperture layer 407 includes a set of three apertures 409. In FIG. 4A, the shutter assembly 400 is in the open state and, as such, the shutter-open actuator 402 has been actuated, the shutter-close actuator 404 is in its relaxed position, and the centerlines of the shutter apertures 412 coincide with the centerlines of two of the aperture layer apertures 409. In FIG. 4B the shutter assembly 400 has been moved to the closed state and, as such, the shutter-open actuator 402 is in its relaxed position, the shutter-close actuator 404 has been actuated, and the light blocking portions of the shutter 406 are now in position to block transmission of light through the apertures 409 (depicted as dotted lines).

Each aperture has at least one edge around its periphery. For example, the rectangular apertures 409 have four edges. In alternative implementations in which circular, elliptical, oval, or other curved apertures are formed in the aperture layer 407, each aperture may have only a single edge. In some other implementations, the apertures need not be separated or disjoint in the mathematical sense, but instead can be connected. That is to say, while portions or shaped sections of the aperture may maintain a correspondence to each shutter, several of these sections may be connected such that a single continuous perimeter of the aperture is shared by multiple shutters.

In order to allow light with a variety of exit angles to pass through apertures 412 and 409 in the open state, it is advantageous to provide a width or size for shutter apertures 412 which is larger than a corresponding width or size of apertures 409 in the aperture layer 407. In order to effectively block light from escaping in the closed state, it is preferable that the light blocking portions of the shutter 406 overlap the apertures 409. FIG. 4B shows a predefined overlap 416 between the edge of light blocking portions in the shutter 406 and one edge of the aperture 409 formed in the aperture layer 407.

The electrostatic actuators 402 and 404 are designed so that their voltage-displacement behavior provides a bi-stable characteristic to the shutter assembly 400. For each of the shutter-open and shutter-close actuators there exists a range of voltages below the actuation voltage, which if applied while that actuator is in the closed state (with the shutter being either open or closed), will hold the actuator closed and the shutter in position, even after an actuation voltage is applied to the opposing actuator. The minimum voltage needed to maintain a shutter's position against such an opposing force is referred to as a maintenance voltage $V_m$.

Figure 5:
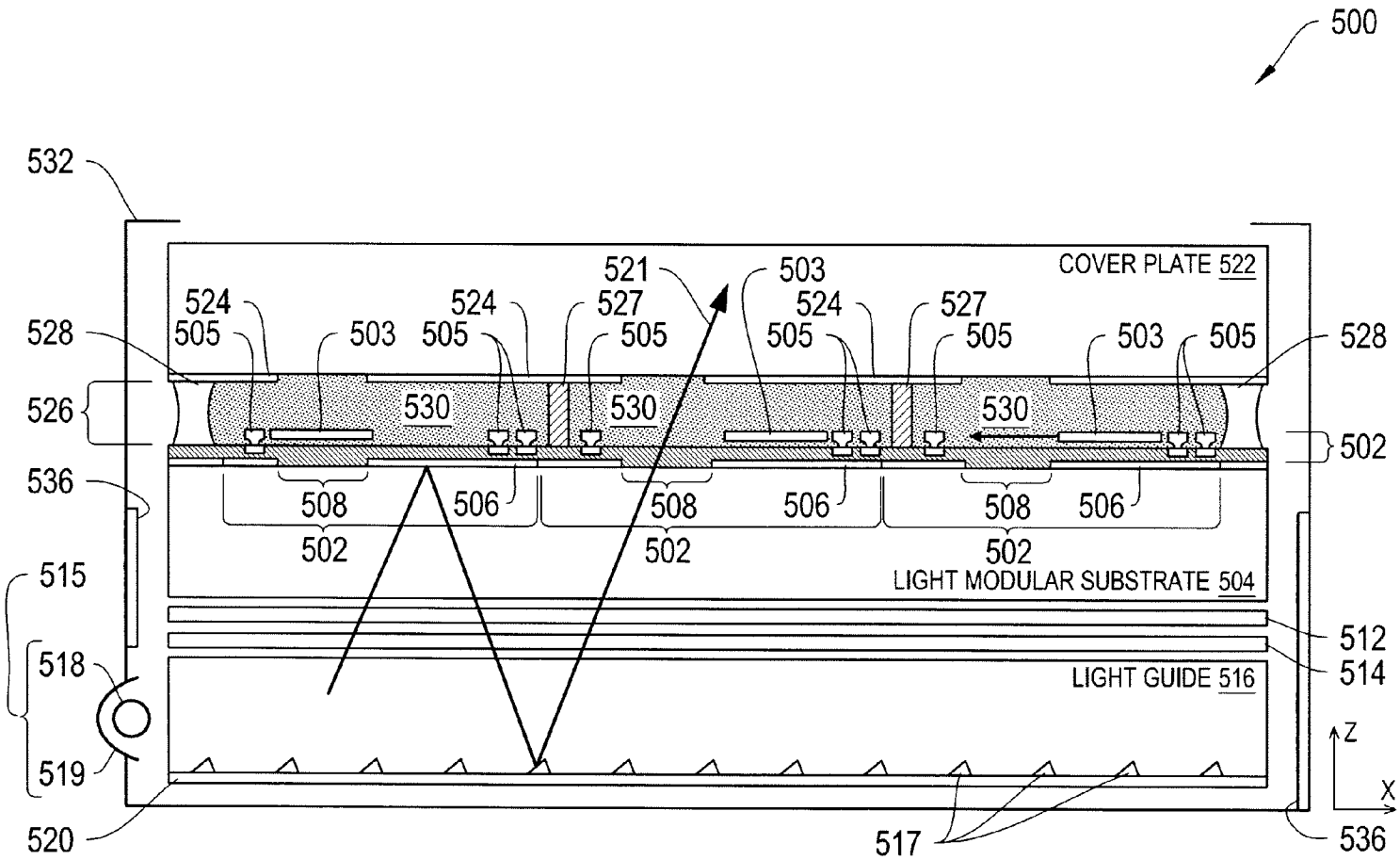
FIG. 5 shows a cross sectional view of an example display apparatus incorporating shutter-based light modulators.

FIG. 5 shows a cross sectional view of an example display apparatus 500 incorporating shutter-based light modulators (shutter assemblies) 502. Each shutter assembly 502 incorporates a shutter 503 and an anchor 505. Not shown are the compliant beam actuators which, when connected between the anchors 505 and the shutters 503, help to suspend the shutters 503 a short distance above the surface. The shutter assemblies 502 are disposed on a transparent substrate 504, such a substrate made of plastic or glass. A rear-facing reflective layer, reflective film 506, disposed on the substrate 504 defines a plurality of surface apertures 508 located beneath the closed positions of the shutters 503 of the shutter assemblies 502. The reflective film 506 reflects light not passing through the surface apertures 508 back towards the rear of the display apparatus 500. The reflective aperture layer 506 can be a fine-grained metal film without inclusions formed in thin film fashion by a number of vapor deposition techniques including sputtering, evaporation, ion plating, laser ablation, or chemical vapor deposition (CVD). In some other implementations, the rear-facing reflective layer 506 can be formed from a mirror, such as a dielectric mirror. A dielectric mirror can be fabricated as a stack of dielectric thin films which alternate between materials of high and low refractive index. The vertical gap which separates the shutters 503 from the reflective film 506, within which the shutter is free to move, is in the range of 0.5 to 10 microns. The magnitude of the vertical gap is preferably less than the lateral overlap between the edge of shutters 503 and the edge of apertures 508 in the closed state, such as the overlap 416 depicted in FIG. 4B.

The display apparatus 500 includes an optional diffuser 512 and/or an optional brightness enhancing film 514 which separate the substrate 504 from a planar light guide 516. The light guide 516 includes a transparent, i.e., glass or plastic material. The light guide 516 is illuminated by one or more light sources 518, forming a backlight 515. The light sources 518 can be, for example, and without limitation, incandescent lamps, fluorescent lamps, lasers or light emitting diodes (LEDs). A reflector 519 helps direct light from lamp 518 towards the light guide 516. A front-facing reflective film 520 is disposed behind the backlight 515, reflecting light towards the shutter assemblies 502. Light rays such as ray 521 from the backlight 515 that do not pass through one of the shutter assemblies 502 will be returned to the backlight 515 and reflected again from the film 520. In this fashion light that fails to leave the display apparatus 500 to form an image on the first pass can be recycled and made available for transmission through other open apertures in the array of shutter assemblies 502. Such light recycling has been shown to increase the illumination efficiency of the display.

The light guide 516 includes a set of geometric light redirectors or prisms 517 which re-direct light from the lamps 518 towards the apertures 508 and hence toward the front of the display. The light redirectors 517 can be molded into the plastic body of light guide 516 with shapes that can be alternately triangular, trapezoidal, or curved in cross section. The density of the prisms 517 generally increases with distance from the lamp 518.

In some implementations, the aperture layer 506 can be made of a light absorbing material, and in alternate implementations the surfaces of shutter 503 can be coated with either a light absorbing or a light reflecting material. In some other implementations, the aperture layer 506 can be deposited directly on the surface of the light guide 516. In some implementations, the aperture layer 506 need not be disposed on the same substrate as the shutters 503 and anchors 505 (such as in the MEMS-down configuration described below).

In some implementations, the light sources 518 can include lamps of different colors, for instance, the colors red, green and blue. A color image can be formed by sequentially illuminating images with lamps of different colors at a rate sufficient for the human brain to average the different colored images into a single multi-color image. The various color-specific images are formed using the array of shutter assemblies 502. In another implementation, the light source 518 includes lamps having more than three different colors. For example, the light source 518 may have red, green, blue and white lamps, or red, green, blue and yellow lamps. In some other implementations, the light source 518 may include cyan, magenta, yellow and white lamps, red, green, blue and white lamps. In some other implementations, additional lamps may be included in the light source 518. For example, if using five colors, the light source 518 may include red, green, blue, cyan and yellow lamps. In some other implementations, the light source 518 may include white, orange, blue, purple and green lamps or white, blue, yellow, red and cyan lamps. If using six colors, the light source 518 may include red, green, blue, cyan, magenta and yellow lamps or white, cyan, magenta, yellow, orange and green lamps.

A cover plate 522 forms the front of the display apparatus 500. The rear side of the cover plate 522 can be covered with a black matrix 524 to increase contrast. In alternate implementations the cover plate includes color filters, for instance distinct red, green, and blue filters corresponding to different ones of the shutter assemblies 502. The cover plate 522 is supported a predetermined distance away from the shutter assemblies 502 forming a gap 526. The gap 526 is maintained by mechanical supports or spacers 527 and/or by an adhesive seal 528 attaching the cover plate 522 to the substrate 504.

The adhesive seal 528 seals in a fluid 530. The fluid 530 is engineered with viscosities preferably below about 10 centipoise and with relative dielectric constant preferably above about 2.0, and dielectric breakdown strengths above about $10^4$ V/cm. The fluid 530 also can serve as a lubricant. In some implementations, the fluid 530 is a hydrophobic liquid with a high surface wetting capability. In alternate implementations, the fluid 530 has a refractive index that is either greater than or less than that of the substrate 504.

Displays that incorporate mechanical light modulators can include hundreds, thousands, or in some cases, millions of moving elements. In some devices, every movement of an element provides an opportunity for static friction to disable one or more of the elements. This movement is facilitated by immersing all the parts in a fluid (also referred to as fluid 530) and sealing the fluid (such as with an adhesive) within a fluid space or gap in a MEMS display cell. The fluid 530 is usually one with a low coefficient of friction, low viscosity, and minimal degradation effects over the long term. When the MEMS-based display assembly includes a liquid for the fluid 530, the liquid at least partially surrounds some of the moving parts of the MEMS-based light modulator. In some implementations, in order to reduce the actuation voltages, the liquid has a viscosity below 70 centipoise. In some other implementations, the liquid has a viscosity below 10 centipoise. Liquids with viscosities below 70 centipoise can include materials with low molecular weights: below 4000 grams/mole, or in some cases below 400 grams/mole. Fluids 530 that also may be suitable for such implementations include, without limitation, de-ionized water, methanol, ethanol and other alcohols, paraffins, olefins, ethers, silicone oils, fluorinated silicone oils, or other natural or synthetic solvents or lubricants. Useful fluids can be polydimethylsiloxanes (PDMS), such as hexamethyldisiloxane and octamethyltrisiloxane, or alkyl methyl siloxanes such as hexylpentamethyldisiloxane. Useful fluids can be alkanes, such as octane or decane. Useful fluids can be nitroalkanes, such as nitromethane. Useful fluids can be aromatic compounds, such as toluene or diethylbenzene. Useful fluids can be ketones, such as butanone or methyl isobutyl ketone. Useful fluids can be chlorocarbons, such as chlorobenzene. Useful fluids can be chlorofluorocarbons, such as dichlorofluoroethane or chlorotrifluoroethylene. Other fluids considered for these display assemblies include butyl acetate and dimethylformamide. Still other useful fluids for these displays include hydro fluoro ethers, perfluoropolyethers, hydro fluoro poly ethers, pentanol, and butanol. Example suitable hydro fluoro ethers include ethyl nonafluorobutyl ether and 2-trifluoromethyl-3-ethoxydodecafluorohexane.

A sheet metal or molded plastic assembly bracket 532 holds the cover plate 522, the substrate 504, the backlight 515 and the other component parts together around the edges. The assembly bracket 532 is fastened with screws or indent tabs to add rigidity to the combined display apparatus 500. In some implementations, the light source 518 is molded in place by an epoxy potting compound. Reflectors 536 help return light escaping from the edges of the light guide 516 back into the light guide 516. Not depicted in FIG. 5 are electrical interconnects which provide control signals as well as power to the shutter assemblies 502 and the lamps 518.

In some other implementations, the roller-based light modulator 220, the light tap 250, or the electrowetting-based light modulation array 270, as depicted in FIGS. 2A-2D, as well as other MEMS-based light modulators, can be substituted for the shutter assemblies 502 within the display apparatus 500.

The display apparatus 500 is referred to as the MEMS-up configuration, wherein the MEMS based light modulators are formed on a front surface of the substrate 504, i.e., the surface that faces toward the viewer. The shutter assemblies 502 are built directly on top of the reflective aperture layer 506. In an alternate implementation, referred to as the MEMS-down configuration, the shutter assemblies are disposed on a substrate separate from the substrate on which the reflective aperture layer is formed. The substrate on which the reflective aperture layer is formed, defining a plurality of apertures, is referred to herein as the aperture plate. In the MEMS-down configuration, the substrate that carries the MEMS-based light modulators takes the place of the cover plate 522 in the display apparatus 500 and is oriented such that the MEMS-based light modulators are positioned on the rear surface of the top substrate, i.e., the surface that faces away from the viewer and toward the light guide 516. The MEMS-based light modulators are thereby positioned directly opposite to and across a gap from the reflective aperture layer 506. The gap can be maintained by a series of spacer posts connecting the aperture plate and the substrate on which the MEMS modulators are formed. In some implementations, the spacers are disposed within or between each pixel in the array. The gap or distance that separates the MEMS light modulators from their corresponding apertures is preferably less than 10 microns, or a distance that is less than the overlap between shutters and apertures, such as overlap 416.

Figure 6:
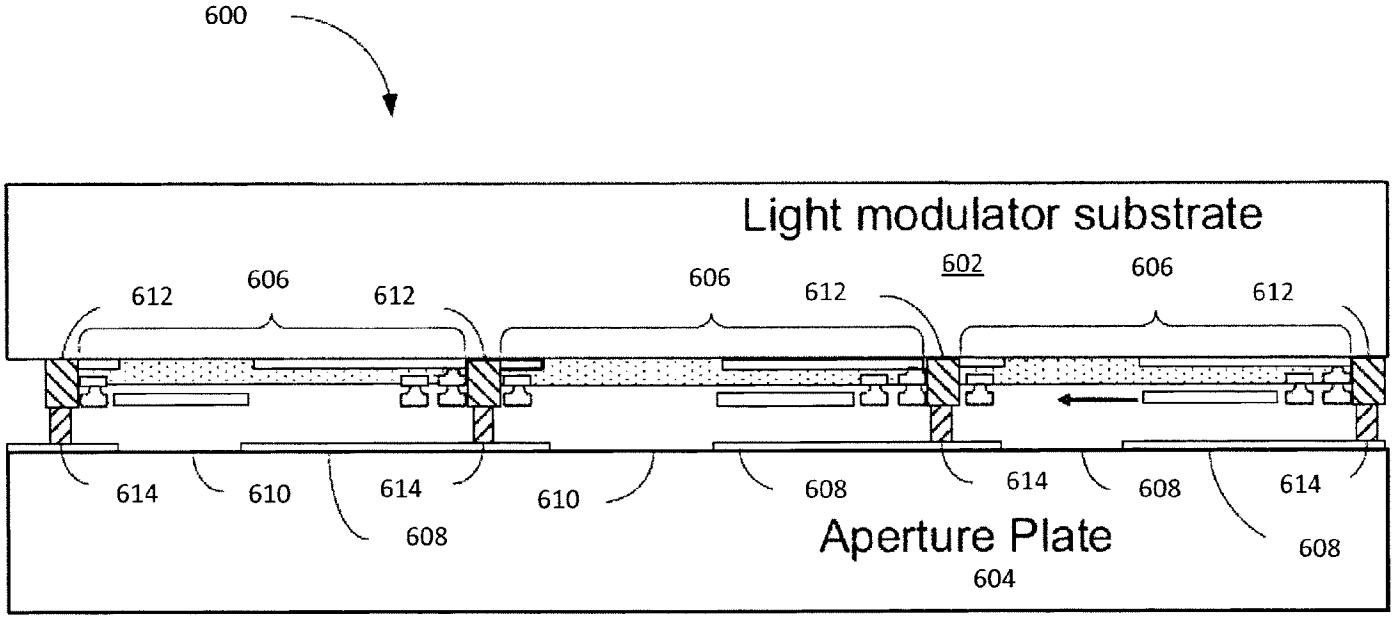
FIG. 6 shows a cross sectional view of an example light modulator substrate and an example aperture plate for use in a MEMS-down configuration of a display.

FIG. 6 shows a cross sectional view of an example light modulator substrate and an example aperture plate for use in a MEMS-down configuration of a display. The display assembly 600 includes a modulator substrate 602 and an aperture plate 604. The display assembly 600 also includes a set of shutter assemblies 606 and a reflective aperture layer 608. The reflective aperture layer 608 includes apertures 610. A predetermined gap or separation between the modulator substrates 602 and the aperture plate 604 is maintained by the opposing set of spacers 612 and 614. The spacers 612 are formed on or as part of the modulator substrate 602. The spacers 614 are formed on or as part of the aperture plate 604. During assembly, the two substrates 602 and 604 are aligned so that spacers 612 on the modulator substrate 602 make contact with their respective spacers 614.

The separation or distance of this illustrative example is 8 microns. To establish this separation, the spacers 612 are 2 microns tall and the spacers 614 are 6 microns tall. Alternately, both spacers 612 and 614 can be 4 microns tall, or the spacers 612 can be 6 microns tall while the spacers 614 are 2 microns tall. In fact, any combination of spacer heights can be employed as long as their total height establishes the desired separation H12.

Providing spacers on both of the substrates 602 and 604, which are then aligned or mated during assembly, has advantages with respect to materials and processing costs. The provision of a very tall, such as larger than 8 micron spacers, can be costly as it can require relatively long times for the cure, exposure, and development of a photo-imageable polymer. The use of mating spacers as in display assembly 600 allows for the use of thinner coatings of the polymer on each of the substrates.

In another implementation, the spacers 612 which are formed on the modulator substrate 602 can be formed from the same materials and patterning blocks that were used to form the shutter assemblies 606. For instance, the anchors employed for shutter assemblies 606 also can perform a function similar to spacer 612. In this implementation, a separate application of a polymer material to form a spacer would not be required and a separate exposure mask for the spacers would not be required.

Figure 7:
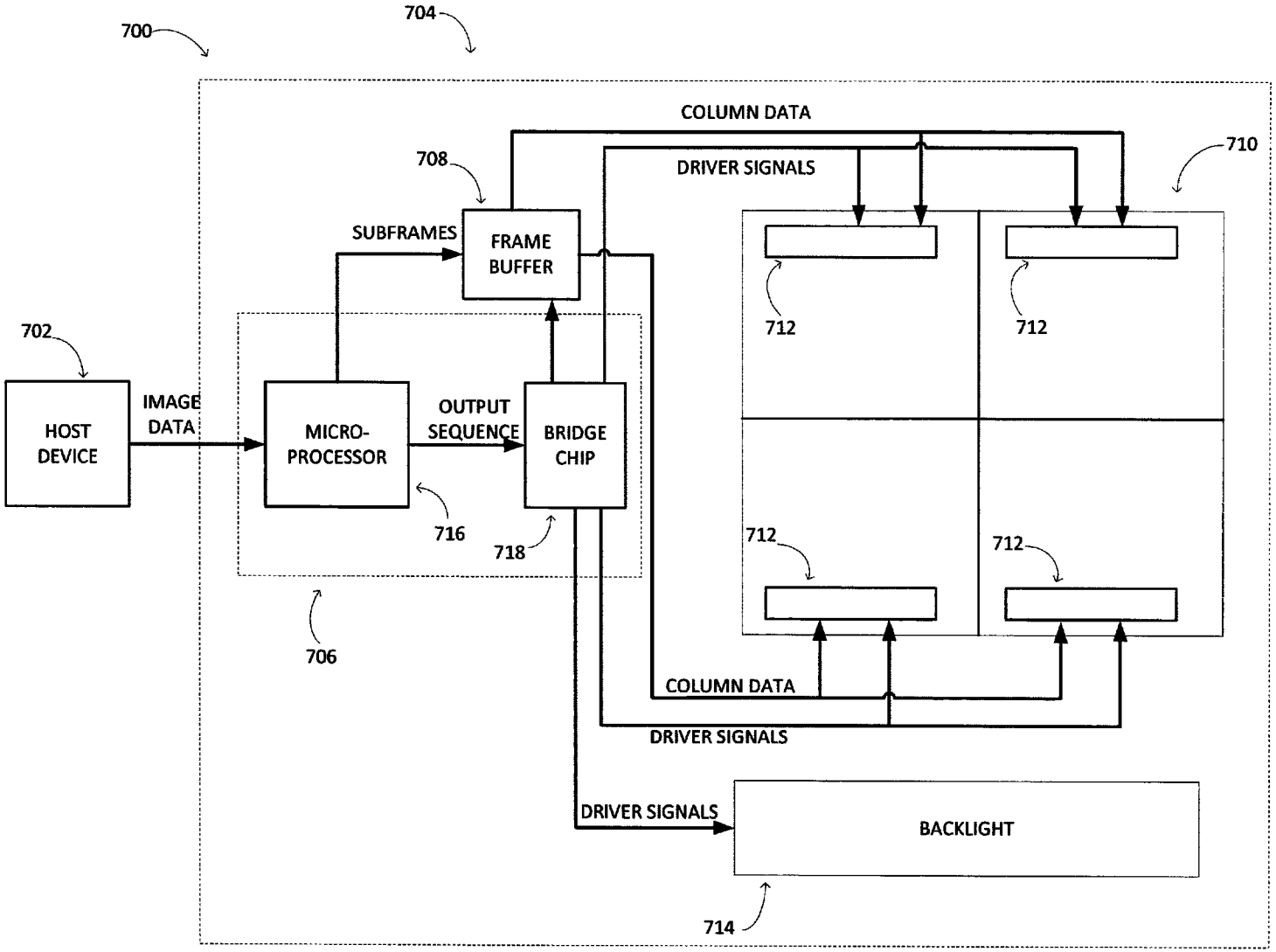
FIG. 7 shows a block diagram of an example display apparatus.

FIG. 7 shows a block diagram of an example display apparatus 700. The display apparatus 700 includes a host device 702 and a display module 704. The host device can be any of a number of electronic devices including a portable telephone, a smart phone, a tablet computer, a laptop computer, a desktop computer, a television, a set top box, a DVD or other media player, or any other device that provides graphical output to a display device. In general, the host device 702 serves as a source for image data to be displayed on the display modulate 704.

The display module 704 further includes control logic 706, a frame buffer 708, an array of display elements 710, display drivers 712, and a backlight 714. In general, the control logic 706 serves to process image data received from the host device 702 and controls the display drivers 712, array of display elements 710, and backlight 714 to together produce the images encoded in the image data.

In some implementations, as shown in FIG. 7, the functionality of the control logic 706 is divided between a microprocessor 716 and a bridge chip 718. In some implementations, the bridge chip 718 is implemented in an integrated circuit logic device, such as an application specific integrated circuit (ASIC). In some implementations, the microprocessor 716 is configured to carry out all or substantially all of the image processing functionality of the control logic 706, as well as determining an appropriate output sequence for the display module 704 to use to generate received images. For example, the microprocessor 716 can be configured to convert image frames included in the received image data into a set of image subframes. Each image subframe is associated with a color and a weight, and includes desired states of each of the display elements in the array of display elements 710. The microprocessor can also be configured to determine the number of image subframes to display to produce a given image frame, the order in which the image subframes are to be displayed, and parameters associated with implementing the appropriate weight for each of the image subframes. These parameters may include, in various implementations, the duration for which each of the respective image subframes is to be illuminated and the intensity of such illumination. These parameters (i.e., the number of subframes, the order and timing of their output, and their weight implementation parameters for each subframe) can be collectively referred to as an "output sequence."

In contrast, the bridge chip 718 is configured primarily to carry out more routine operations of the display module 704. The operations may include retrieving image subframes from a frame buffer 708 and outputting control signals to the display drivers 712 and the backlight 714 in response to the retrieved image subframe and the output sequence determined by the microprocessor 716. The frame buffer 708 can be any volatile or non-volatile integrated circuit memory, such as DRAM, high-speed cache memory, or flash memory. In some other implementations, the bridge chip 718 causes the frame buffer 708 to output data signals directly to the display drivers 712. The functionality of the control logic 706 is described further below in relation to FIGS. 8-13.

In some other implementations, the functionality of the microprocessor 716 and the bridge chip 718 are combined into a single logic device, which may take the form of a microprocessor, an ASIC, a field programmable gate array (FPGA) or other programmable logic device. In some other implementations, the functionality of the microprocessor 716 and the bridge chip 718 may be divided in other ways between multiple logic devices, including one or more microprocessors, ASICs, FPGAs, digital signal processors (DSPs) or other logic devices.

The array of display elements 710 can include an array of EMS light modulators. In some implementations, the display elements are MEMS shutter-based light modulators similar to those shown in FIG. 4A or 4B. In some other implementations, the display elements can be other forms of light modulators, including liquid crystal light modulators, other types of EMS based light modulators, or light emitters, such as OLED emitters, configured for use with a time division gray scale image formation process.

The display drivers 712 can include a variety of drivers depending on the specific control matrix used to control the display elements in the array of display elements 710. In some implementations, the display drivers 712 include a plurality of scan drivers similar to the scan drivers 130, a plurality of data drivers similar to the data drivers 132, and a set of common drivers similar to the common drivers 138, all shown in FIG. 1B. As described above, the scan drivers output write enabling voltages to rows of display elements, while the data drivers output data signals along columns of display elements. The common drivers output signals to display elements in multiple rows and multiple columns of display elements.

In some implementations, particularly for larger display modules 704, the control matrix used to control the display elements in the array of display elements 710 is segmented into multiple regions. For example, the array of display elements 710 shown in FIG. 7 is segmented into four quadrants. A separate set of display drivers 712 is coupled to each quadrant. Dividing a display into segments in this fashion reduces the propagation time needed for signals output by the display drivers to reach the furthest display element coupled to a given driver, thereby decreasing the time needed to address the display. Such segmentation can also reduce the power requirements of the drivers employed.

As shown in FIG. 7, the display drivers 712 are coupled directly to the glass substrate on which the display elements are formed. In such implementations, the drivers are built using a chip-on-glass configuration. In some other implementations, the drivers are built on a separate circuit board and the outputs of the drivers are coupled to the substrate using, for example, flex cables or other wiring.

The backlight 714 includes a light guide, one or more light sources (such as LEDs), and light source drivers. The light sources include light source of multiple primary colors, such as red, green, blue, and in some implementations white. The light source drivers are configured to individually drive the light sources to a plurality of discrete light levels to enable illumination gray scale and/or content adaptive backlight control (CABC) in the backlight. The light guide distributes the light output by light sources substantially evenly beneath the array of display elements 710. In some other implementations, for example for displays including reflective display elements, the display apparatus 700 can include a front light or other form of lighting instead of a backlight. The illumination of such alternative light sources can likewise be controlled according to illumination grayscale processes that incorporate content adaptive control features. For ease of explanation, the display processes discussed herein are described with respect to the use of a backlight. However, it would be understood by a person of ordinary skill that such processes may be also be adapted for use with a front light or other similar form of display lighting.

Figure 8:
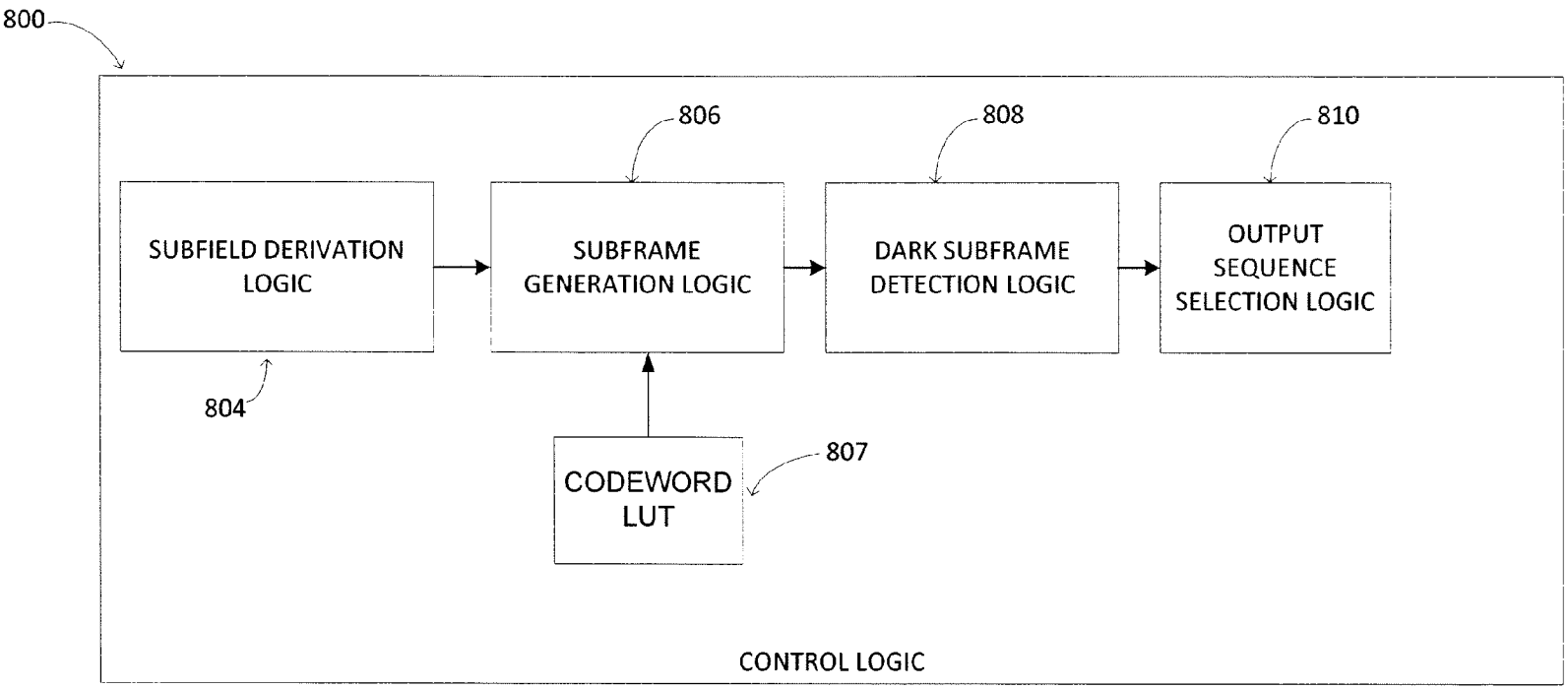
FIG. 8 shows a block diagram of example control logic suitable for use in the display apparatus shown in FIG. 7.

FIG. 8 shows a block diagram of example control logic 800 suitable for use in the display apparatus 700 shown in FIG. 7. More particularly, FIG. 8 shows a block diagram of functional modules executed by the microprocessor 716. Each functional module can be implemented as software in the form of computer executable instructions stored on a tangible computer readable medium, which can be executed by the microprocessor 716. The control logic 800 includes subfield derivation logic 804, subframe generation logic 806, a codeword lookup table (LUT) 807, dark subframe detection logic 808, and output sequence selection logic 810. While shown as separate functional modules in FIG. 8, in some implementations, the functionality of two or more of the modules may be combined into one or more larger, more comprehensive modules.

Figure 9:
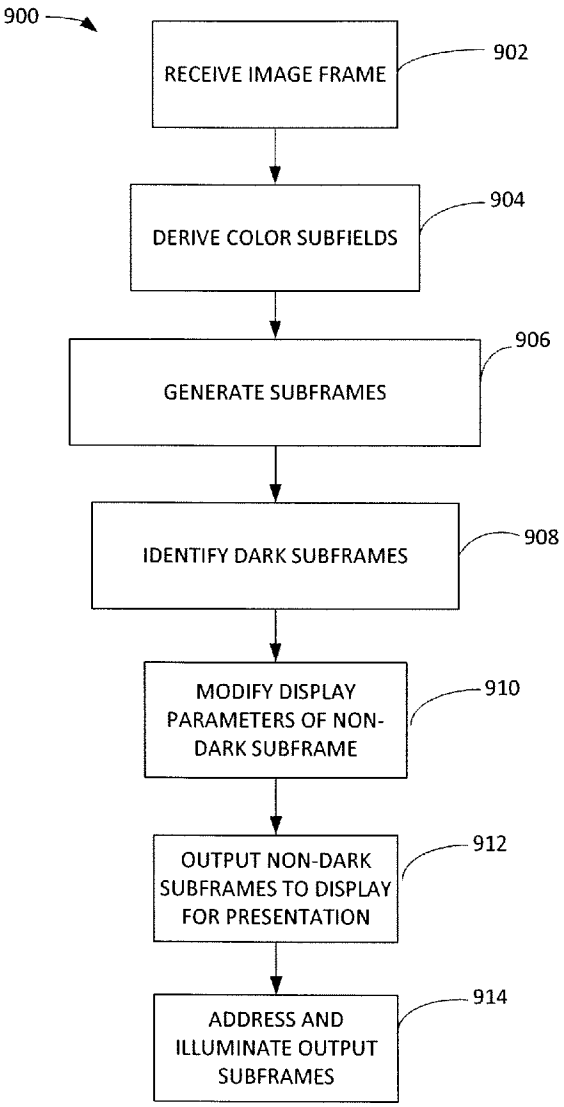
FIG. 9 shows a flow diagram of an example method for generating an image on a display.

When executed by the microprocessor 716, the components of the control logic 800, along with the bridge chip 718, display drivers 712, and backlight 714 (all shown in FIG. 7), function to carry out a method for generating an image on a display. FIG. 9 is flow diagram of such a method.

FIG. 9 shows a flow diagram of an example method 900 for generating an image on a display. The method 900 includes receiving and image frame (stage 902), deriving color subfields for the image frame (stage 904), generating subframes based on the derived color subfields (stage 906), identifying dark subframes (stage 908), modifying display parameters of at least one non-dark subframe (stage 910), outputting non-dark subframes to a display for presentation (stage 912) and addressing and illuminating output subframes (stage 914).

Referring to FIGS. 7-9, the method 900 begins with receiving image data in the form of a series of image frames (stage 902). Typically, such image data is obtained as a stream of intensity values for the red, green, and blue components of each pixel in an image frame. The intensity values typically are received as binary numbers.

The subfield derivation logic 804 then derives and stores a set of color subfields for the image frame based on the received image data as (stage 904). Each color subfield includes for each pixel in the display an intensity value indicating the amount of light to be transmitted by that pixel, for that color, to form the image frame.

In some implementations, the subfield derivation logic 804 derives the set of color subfields by segregating the pixel intensity values for each primary color represented in the received image data (i.e., red, green, and blue). In some other implementations, the subfield derivation logic 804 processes the received image data further to derive color subfields for one or more primary colors other than those represented in the image data. For example, the subfield derivation logic 804 may derive a white, cyan, yellow, or magenta subfield, or a subfield for another color that can be formed through illumination of a combination of two or more of the display light sources. Light energy assigned to this additional subfield is then subtracted from the color subfields associated with the input colors. In some implementations, one or more image preprocessing steps, such as gamma correction, may also be carried out by the subfield derivation logic prior to or in the process of deriving the image subframes.

The subframe generation logic 806 then converts each of the derived subfields into sets of subframes (stage 906). Each subframe corresponds to a particular time slot in a time division gray scale image output sequence. It includes a desired state of each display element in the display for that time slot. In each time slot, a display element can take either a non-transmissive state or one or more states that allow for varying degrees of light transmission.

In some implementations, the subframe generation logic 806 uses the code word LUT 807 to generate the subframes (stage 906). More particularly, in some implementations the codeword LUT 807 stores a series of binary values referred to as code words that indicate a series of display element states that result in a given pixel value. The value of each digit in the code word indicates a display element state (for example, light or dark) and the position of the digit in the code word represents the weight that is to be attributed to the state. In some implementations, the weights are assigned to each digit in the code word such that each digit is assigned a weight that is twice the weight of a preceding digit. In some other implementations, multiple digits of a code word may be assigned the same weight. In some other implementations, each digit is assigned a different weight, but the weights may not all increase linearly, digit to digit.

To generate a set of subframes (stage 906), the subframe generation logic 806 obtains code words for all pixel values in a color subfield. The subframe generation logic 806 then aggregates the digits in each of the respective positions in the code words for each pixel together into subframes. For example, the digits in the first position of each code word for each pixel are aggregated into a first subframe. The digits in the second position of each code word for each pixel are aggregated into a second subframe.

In some other implementations, particularly for implementations using light modulators capable of achieving one or more partially transmissive states, the code word LUT 807 may store code words using base-3, base-4, base-10, or some other numbering scheme.

In some implementations, additional processing may be carried out on a derived subfield prior to generation of subframes. For example, in some implementations, the subfield derivation logic 804 or the subframe generation logic 806 may implement content adaptive backlight control (CABC) logic. In some implementations, CABC logic is configured to identify a highest pixel intensity value in a subfield and scale all the pixel values in the subfield such that the pixel value of the pixel with the highest intensity level is equal to the maximum intensity value used by the display (for example 255 for some 8-bit per color imaging processes). The scaling factor used to adjust the pixel intensity values is then passed to the output sequence selection logic 810 to adjust the output intensity of the backlight 714 for the color subfield based on the scaling factor. In some other implementations, other CABC logic may be implemented.

The dark subframe detection logic 808 then analyzes the generated subframes or the derived subfields to identify dark subframes (stage 908). In some implementations, a dark subframe is a subframe, i.e., subframes in which all display elements are desired to be in the non-transmissive state. In some other implementations, a subframe may be determined to be a dark subframe even it indicates some limited number of display elements are to be in a transmissive state. For example, in various implementations, a subframe may be considered dark if less than 1%, less 0.1%, or less than 0.001% of the light modulators in the display are in a transmissive state. In some implementations, a subframe indicating fewer than the a threshold number of transmissive display elements may only be considered "dark" if the weight of the subframe is below a selected subframe significance. For example, the threshold may only apply to the 1, 2, or 3 subframes having the least significance. In some implementations, the threshold for the number of transmissive state display elements may vary inversely with respect to the significance of the subframe being evaluated. One example process for identifying dark subframes is described below in relation to FIG. 10.

Based on the identification of any dark subframes (stage 908), the output sequence selection logic 810 modifies the display parameters of one or more non-dark subframes (stage 910). To do so, the output sequence selection logic 810 removes the display of the identified dark subframes from the display's output sequence. It then harvests and reallocates the time that would have been spent addressing and illuminating the display with the dark subframe to the display of non-dark subframes.

As described further below in relation to FIGS. 11-14, this harvested time can be used in a number of ways. For example, as discussed further in relation to FIG. 11, time harvested from dark subframes of a given color can be distributed among non-dark subframes of the same color. As shown in FIG. 12, the extra time can be used to divide the display of a higher weighted subframe into two time periods within the time allocated for display of the image frame. The divided subframe can be of the same color as the dark subframe or of a different color. The total illumination time for the subframe may be the same; however, displaying a subframe a second time requires some amount of time to reload the subframe into the display elements. The harvested time is used to account for this addressing time. As shown in FIGS. 13 and 14, the harvested time can be used to display additional lower weighted subframes for which there may not have been enough time to display if the dark subframes were displayed. The output sequence selection logic 810 may be configured to apply one or more the techniques described above. The output sequence selection logic 810 may select one or more time reallocation techniques based on the amount of time harvested from dark subframes, the content of the image, user or application preference, or other factors. The modifications result in updates to the display's output sequence.

After the display parameters of the subframes are modified, as necessary, based on the identification of dark subframes (stage 910), the control logic 706 causes the non-dark subframes to be output to the array of display elements 710 (stage 912) according to the updated output sequence. In some implementations, at times indicated in the output sequence, the bridge chip 718 causes the frame buffer 708 to output respective subframes to the array of display elements 710. The subframes to be output may be identified in the output sequence by respective memory addresses introduced in the output sequence by the output sequence selection logic 810. The display element states included in the subframes may be stored in registers co-located with the display drivers 712.

The subframes are sequentially addressed into the display and are illuminated (stage 914) to produce the image frame. The display drivers load the display element states included in each subframe into the display elements. After a subframe is fully loaded into the array of display elements 710, the bridge chip 718 causes the appropriate light sources of the backlight 714 to be illuminated for an amount of time indicated in the output sequence. The human visual system of a user viewing the display integrates the displayed series of subframes together, resulting in the perception of the image encoded in the received image frame.

Figure 10:
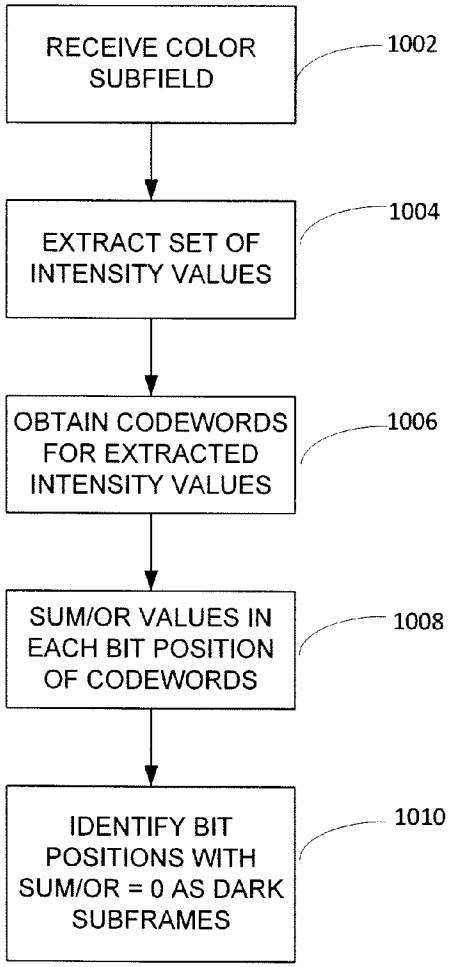
FIG. 10 shows a flow diagram of an example method for identifying dark subframes.

FIG. 10 shows a flow diagram of an example method 1000 for identifying dark subframes. Referring to FIGS. 7, 8, and 10, the method 1000 begins with the receipt of a color subfield from the subfield derivation logic 804 (stage 1002). Intensity values from the received color subfield are then extracted (stage 1004). In some implementations, the color subfield is processed by a histogram function that identifies all of the different intensity values included in the subfield. Using the code word LUT 807, the control logic 706 obtains code words for all of the identified pixel intensity values (stage 1006). One code word position at a time, the control logic 706 carries out a summation or OR function on the values of all of the identified code words at the respective positions (stage 1008). If the result of the summation or the OR function for a code-word position is equal to zero, which will only occur if the values in all identified code words at the position are themselves equal to zero, the control logic 706 identifies the subframe associated with that code word position as a dark subframe (stage 1010).

Consider the following example. Assume a display receives an image subframe that results in a color subfield that includes pixel intensity values of 132, 130, 129, 35, 33, 32, and 10. If the display is using an 8-bit binary weighting scheme for its subframes, the code words for each of these pixel values would be as set forth in Table 1 below.

TABLE 1

| Pixel Intensity Value | Code Word |
|---|---|
| 132 | 10000100 |
| 130 | 10000010 |
| 129 | 10000001 |
| 35 | 00100011 |
| 33 | 00100001 |
| 32 | 00100000 |
| 10 | 00101010 |

In the code words in Table 1, the sum and OR value of the binary digits in the second and fourth positions from the left are all zero. Thus, in the subframes corresponding to the second and fourth positions of the codeword all display elements would be addressed to be dark, resulting in a dark subframe. Accordingly, the example set of pixel intensity values could be displayed using only six subframes even though the subframes are represented by 8-bit code words.

In some other implementations, instead of extracting intensity values from a color subfield using a histogram function, the control logic 706 generates a full set of subframes for the received color subfield. The control logic 706 then applies the summation or OR function to the values of all pixels in each generated subframe. If the sum or OR of all pixel values in a given subframe is equal to zero, the subframe is identified as a dark subframe. In implementations in which dark subframe can indicate a limited number of display elements are intended to be in a transmissive state, the sum of the pixel values can be compared to a threshold value. If the sum falls below the threshold, the subframe is determined to be dark.

Figure 11:
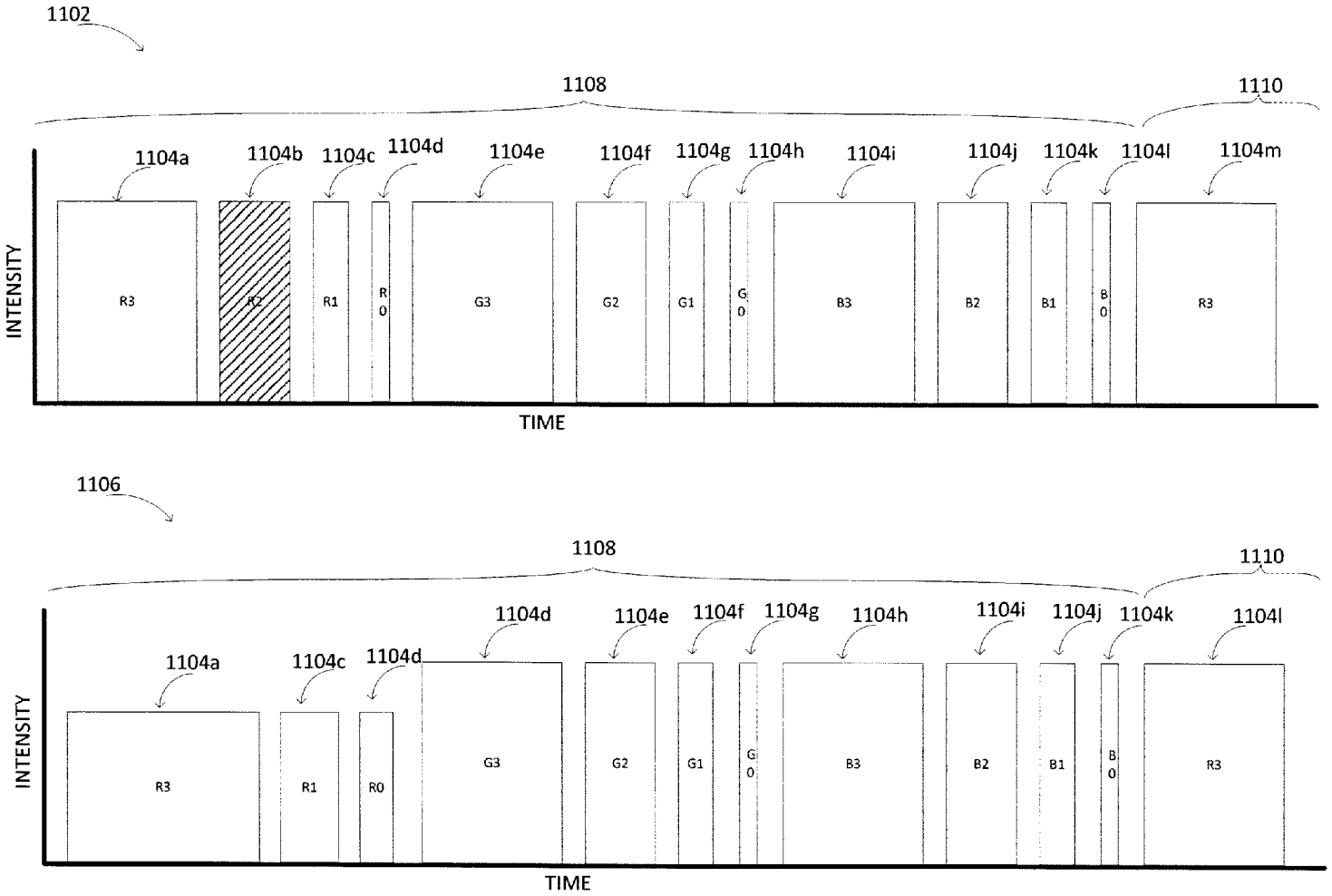
FIGS. 11-14 show timing diagrams illustrating example techniques for utilizing time harvested from dark subframes.
Figure 12:
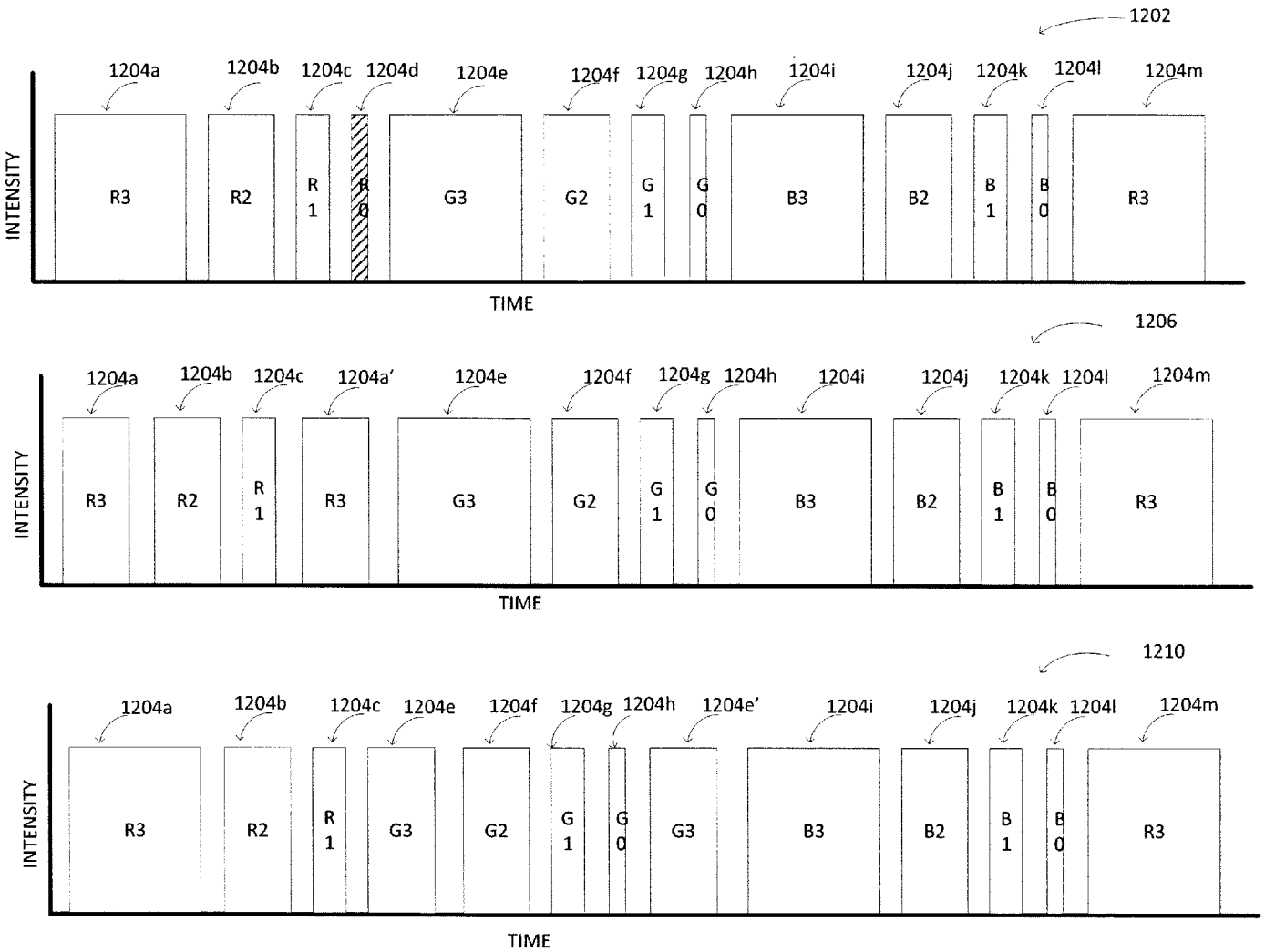
Figure 13:
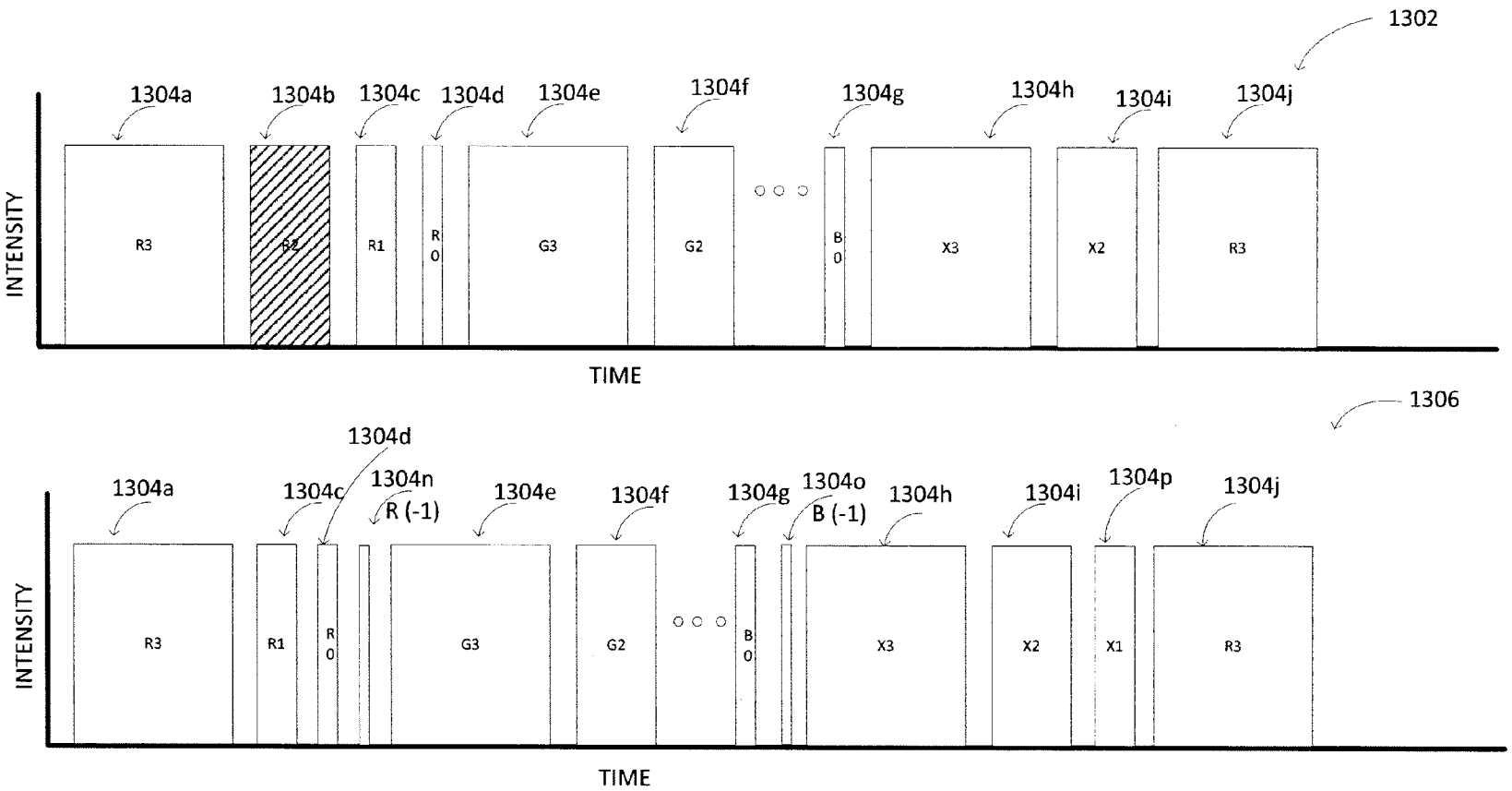
Figure 14:
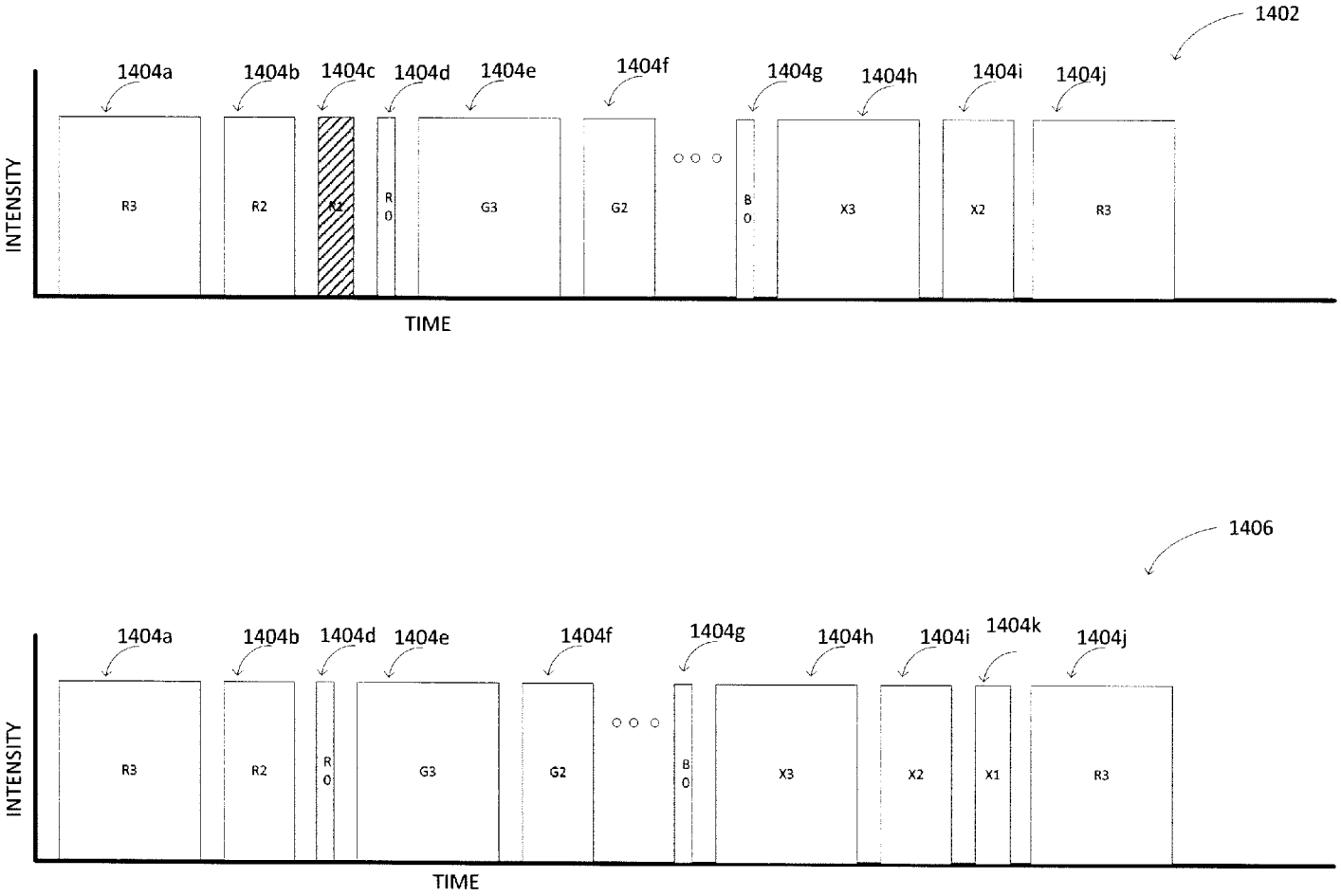

FIGS. 11-13 show timing diagrams illustrating example techniques for utilizing time harvested from dark subframes. FIG. 11 shows a first example technique for utilizing time harvested from dark subframes. In brief overview, FIG. 11 shows a first timing diagram 1102 that includes the display of a plurality of subframes 1104*a*-1104*m* (generally "subframes 1104"), including one dark subframe 1104*b*. FIG. 11 shows a second timing diagram 1106 illustrating an alternative output of the subframes 1104, in which the dark subframe 1104*b* is suppressed. The time that would have been spent addressing and the illuminating the dark subframe 1104*b* is instead distributed amongst other subframes 1104*a*, 1104*c*, and 1104*d*.

More particularly, the timing diagram 1102 shows a series of subframes 1104*a*-1104*l* associated with a first image frame 1108 and the first subframe 1104*m* associated with a second image frame 1110. The first image frame 1108 has been decomposed into twelve subframes 1104, four for each of three primary colors, namely red, green, and blue. As shown in the timing diagram 1102, the height of a given subframe 1104 corresponds to the intensity of a light source used to illuminate the subframe. The width of the subframe 1104 corresponds to the duration for which the subframe 1104 is illuminated, and thus its corresponding weight. As shown, each subframe 1104 in the timing diagram 1102 is illuminated at the same light source intensity level. The subframes 1104 differ in their corresponding color and the time with which they are illuminated. For each color, the timing diagram 1102 includes a most significant subframe, for example subframes R3 1104*a*, G3 1104*e*, and B3 1104*i*, as well as three less significant subframes, R2-R0 1104*b*-1104*d*, G2-G0 1104*f*-1104*h*, and B2-B0 1104*j*-1104*l*. Each subframe 1104 in a given color has half the illumination duration, and thus half the weight, of the preceding subframe of that color for the image frame.

As shown, the subframe R2 1104*b* has been found to be a dark subframe, for example, through application of the method 1000 shown in FIG. 10. Thus, the illumination of the R2 subframe can be omitted without impacting a viewer's perception of the resulting image. In fact, omitting the R2 subframe may improve the resulting image, as doing so may reduce light leakage that might occur during the R2 subframe, which may improve the image's contrast ratio.

Display light sources, such as LEDs operate according to a non-linear power curve. Thus, generating the same light output by operating the light source at a lower power for a longer period of time can result in a substantial power savings in comparison to operating the light source at a higher intensity for a shorter period of time. To leverage this property of many display backlights, the control logic 706, shown in FIG. 7, of a display 700, also shown in FIG. 7, can use time harvested from omitting the display of dark subframes to output one or more other subframes of the same color at lower light source intensities for a greater period of time. Thus, in the timing diagram 1106, the time that would have been spent addressing and illuminating the R2 subframe 1104*b* is harvested and reallocated to the display of the remaining red subframes R3 1104*a*, R1 1104*c*, and R0 1104*d*. As the time allocated to each of these subframes 1104*a*, 1104*c* and 1104*d* is increased, the intensity with which the light source is illuminated for each subframe is proportionately reduced. Thus, as shown in FIG. 11, subframe 1104*a*, 1104*c*, and 1104*d* are shown to be shorter and wider in the second timing diagram 1106 than they are shown in the first timing diagram 1102. This allows the light sources to operate at a more power efficient point on their power curve.

In FIG. 11, time harvested from suppressing a dark subframe in one color is reallocated amongst the remaining subframes of the same color. In some other implementations, the harvested time may be reallocated among other subframes in different ways. For example, in some implementations, the harvested time is allocated to less than all of the remaining subframes of the color. In some other implementations, the harvested time may be allocated to subframes associated with other colors. In some such implementations, the harvested time is allocated proportionately across all non-dark subframes. In some other implementations, one or more colors are allocated a disproportionate amount of harvested time in comparison to other colors. For example, one color may be allocated some 20%, 30%, 50%, 100% or any other percentage more harvested time than one or more other colors.

In some other implementations, image quality can be improved by increasing the number of times one or more subframes are displayed during the time allocated to display an image frame. For example, one or more higher weighted subframes can be presented twice, at different times during the time allocated for displaying the image frame. This can help reduce flicker in the image frame, as well as CBU. In such cases, the total time the subframe is displayed may be the same as if it were displayed only once. The harvested time is instead allocated to reload the subframe into the display elements the second time the subframe is displayed. The benefit of such subframe repetition is increased in output sequences in which subframes of different colors are distributed throughout the output sequence, as opposed to being grouped all together, as shown in FIGS. 11-13. For example, in some such implementations, a first instance of the repeated subframe can be output towards the beginning of the output sequence while the second instance of the repeated subframe is output towards the end of the output sequence.

FIG. 12 shows the application of this example harvested time reallocation technique. FIG. 12, shows three timing diagrams 1202, 1206, and 1210 showing the display of a set of subframes 1204*a*-1204*m* (generally "subframes 1204") before suppression of a dark subframe (timing diagrams 1202) and after two example harvested time reallocation processes (timing diagrams (1206 and 1210). More particularly, the timing diagram 1206 illustrates a process in which time harvested from suppressing a subframe 1204 of a color is reallocated for display of other subframes of that color. The timing diagram 1210 illustrates an example of a process in which harvested time is allocated to a given color (in this case green), regardless of the color associated with dark subframe. In these examples, subframe R0 1204*d* is found to be a dark subframe. As in FIG. 11, the height of each subframe 1204 indicates the intensity with which a corresponding light source is illuminated, and the width of each subframe 1204 indicates the duration for which the subframe is illuminated by the light source.

In the timing diagram 1206, the dark R0 subframe 1204*d* is omitted, and the R3 subframe 1204*a* is displayed twice, once as subframe 1204*a* before the R2 subframe 1204*b* and once after the R1 subframe 1204*c* as subframe 1204*a*'. In both instances, the R3 subframes 1204*a* and 1204*a*' are illuminated with the same light source intensity as all of the other subframes 1204. As shown, the total time duration that the R3 subframes 1204*a* and 1204*a*' are illuminated in the second timing diagram 1206 is equal to the time allocated to the single presentation of the R3 subframe 1204*a* in the first timing diagram 1202.

In the second timing diagram 1206, the second presentation of the R3 subframe 1204*a*' happens to be in the position of the omitted dark R0 subframe 1204*d*. In some implementations, this is done intentionally. In some other implementations, the second presentation of a split subframe is positioned to space it farther from the first presentation of the split subframe, regardless of the position of an omitted dark subframe.

In the third timing diagram, the time harvested from suppressing the R0 subframe 1204*d* is utilized to display the G3 subframe 1204*e* twice as subframes 1204*e* and 1204*e*'. Even though the identified dark subframe R0 1204*d* was a red subframe, the human visual system (HVS) tends to be more sensitive to flicker with respect to green images than to images of other colors. Thus, in some display processes, such as the one represented in the timing diagram 1210, regardless of which color an identified dark subframe may be associated with, such display processes use harvested time first to divide a most significant green subframe (unless it, too, is determined to be dark). Additional harvested time, if any, may be used to divide subframes of other colors or in any of the other ways disclosed herein.

In some other implementations, the display apparatus 700 shown in FIG. 7 can improve image quality by displaying additional lower weight subframes. For example, some displays may receive image data with a higher color resolution (for example, a 12-bit color resolution), but due to time constraints, are only able to display an image frame at a lower color resolution (for example, using only a 6- or 8-bit color resolution). The time harvested from identifying and suppressing dark subframes can be employed by the display 700 to display lower-weighted subframes that would otherwise not have been displayed, creating additional color resolution for that subframe.

FIGS. 13 and 14 show the application of this additional example harvested time reallocation technique. FIG. 13, similar to FIG. 11, shows two timing diagrams 1302 and 1306. As in FIGS. 11 and 12, the height of each subframe 1304 indicates the intensity with which a corresponding light source is illuminated, and the width of each subframe 1304 indicates the duration for which it is illuminated. The timing diagrams 1302 and 1306 are truncated for the sake of clarity.

The timing diagrams 1302 and 1306 differ from the timing diagrams 1102 and 1106 and 1202 and 1206 in that the timing diagrams 1302 and 1306 include subframes of a fourth color (subframes 1304*h*-1304*j* in timing diagram 1302 and subframes 1304*h*-1304*j* and 1304*p* in timing diagram 1306), denoted as the color "X", in addition to red, green, and blue subframes. Some display processes, such as the one illustrated in the timing diagrams 1302 and 1306 form images using a combination of component colors and composite colors. The X color represents a composite color.

Component colors are colors that correspond to the primary colors of a given color gamut, such as red, green, and blue. In some implementations, the component colors may match the colors of the light sources included in a display, though in some other implementations, such colors may be formed by mixing the outputs of multiple colors of light sources to match a color gamut primary color. For example, a display having red, green, and blue light sources may generate its red component color by illuminating its red light source at high intensity and its green and blue light sources at much lower intensities. A component color is a color generated by mixing the primary colors of a color gamut. For example, cyan is a composite of blue and green, magenta is a composite of blue and red, and white is a composite of red, green, and blue. In some implementations, the a display generates a composite color by further mixing of the output of its light sources. In some other implementations, a display can include dedicated light sources for the composite colors it outputs. For example, a display can have a white light source that it uses for illuminating white subframes, as well as for mixing with the output of other light sources to help illuminate subframes associated with component colors or other composite colors.

In some implementations, the specific color of the X subframes shown in the timing diagrams is fixed. For example, the X subframes may always be white or yellow. In some other implementations, the color of the X subframes may be determined based on the image content of the current image frame and/or the content of one or more previous image frames. The use of composite colors in this fashion can help improve image quality and reduce power consumption.

Some display processes that employ composite color subframes generate and output fewer subframes for the X color than for component colors. For example, such processes may generate and output eight subframes for each component color and only four subframes for the composite color. The composite color subframes, in some such implementations, can include higher weighted subframes while omitting lower weighted subframes.

Referring back to FIG. 13, the first timing diagram 1302 shows the display of a set of subframes 1304*a*-1304*j* (generally "subframes 1304") before suppression of a dark subframe, in this case subframe R2 1304*b*. As discussed above, in addition to the R3-R0, G3-G0, and B3-B0 subframes, the timing diagram also includes two higher weighted composite color subframes X3 1304*h* and X2 1304*i*.

The second timing diagram 1306 shows the display of a second set of subframes, including the subframes 1304*a*, 1304*b*, and 1304*d*-1304*j*. In addition, the second timing diagram 1306 includes four additional subframes R(−1) 1304*n*, G(−1) (not shown), B(−1) 1304*o*, and X1 1304*p*_. Three of the additional subframes R(−1_, G−1), and B(−1) have lower weights than any of the original subframes displayed in the timing diagram 1302 and were not displayed due to a lack of time.

As indicated above, in some implementations, lower weighted subframes that might have been output for component colors may be omitted in the first instance for a composite color. Thus, the additional subframe output for the composite color can have a greater weight than the weight of the additional subframes output for one or more of the component colors. Accordingly, the fourth additional subframe, X1, shown in FIG. 13 as subframe 1304(*p*), has a weight equivalent to the R1, G1, and B1 subframes, which is several times greater than the weights of the R(−1), G(−1) or B(−1) subframes. Given the amount of time made available by not having to display the dark R1 subframe 1304*c*, the display now has sufficient time to load the new subframes R(−1), G(−1), B(−1) and X(1) into the display and illuminate them.

As shown in FIG. 13, omitting a dark subframe may provide enough time to for a display to display lower weighted subframes of multiple colors. In some implementations, a display may be configured to, or may decide to, only add additional subframes 1304 for less than all of the colors used by the display. In some implementations, such a decision may be made based on the amount of time harvested as well as the variation in color of each of the display's primary colors in the image being displayed. For example, if an image being displayed includes a number of close pixel intensity values for one color, but not for other colors, the display may elect to use the time it harvests from omitting display of dark subframes disproportionately among the colors it is presenting. For example, the display may add two additional subframes of a first color, and only one or no additional subframes for other colors.

Alternatively, as shown in FIG. 14, harvested time can be first allocated to the outputting of additional composite color subframes, before subframes of a component color. FIG. 14, like FIG. 13 shows two timing diagrams 1402 and 1406 including subframes 1404*a*-1404*j* of four colors. Three of the colors are the component colors red (R), green (G), and blue (B). The fourth color is a composite color X. The timing diagrams 1402 and 1406 show the output sequence for an image before and after identification and suppression of a dark subframe.

In FIG. 14, the R1 subframe 1404*c* is found to be dark. In comparison to FIG. 13, in which the higher weighted R2 subframe 1304*b* was identified as being dark, less time is available for harvesting and reallocation in the timing diagram 1406. Accordingly, instead of adding four new lower weighted subframes, the timing diagram 1406 includes only a single additional subframe X1 1404*k*, associated with the composite color.

In some implementations, a display may be configured to execute multiple ones of the harvested time reallocation techniques discussed above in relation to FIGS. 11-14. In some such implementations, the display can determine which techniques to employ based on the amount of time harvested and the content of an image being displayed.

In some other implementations, the display also may use harvested time to allow its data drivers, such as the data drivers 132, shown in FIG. 1B, to operate using less power. The data drivers can consume less power if operated at a lower slew rate. Such lower-slew rate operation however, slows the process of addressing the display. Accordingly, separately or in combination with one or more of the above described harvested time reallocation techniques, the display can utilize some or all of the time harvested from suppressing dark subframes to allow the data drivers to address one or more subframes in the output sequence at a lower slew rate.

The various timing diagrams 1102, 1106, 1202, 1206, 1210, 1302, 1306, 1402, and 1406 show relatively straight forward output sequences in which all subframes of a given color are shown together in weight order. This arrangement of subframes is provided for ease of explanation. In some implementations, the order of subframes can be varied significantly to help address image artifacts such as dynamic false contouring (DFC) or CBU. For example, subframes of different colors can be interleaved with one another in a variety of patterns to temporally distribute the output of each color throughout the output sequence. In some implementations, for example, the color of each successive subframe may differ from the color of the prior subframe. In some implementations, subframes for each color having the highest weight are shown in immediate succession. In other implementations, the subframes in the output sequence can be organized in a wide variety of orders to address one or more adverse image artifacts.

Figure 15:
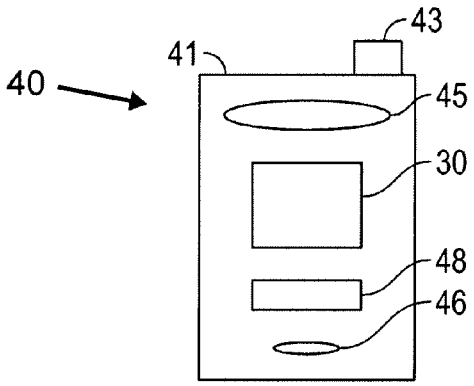
FIGS. 15 and 16 show system block diagrams of an example display device that includes a plurality of display elements.
Figure 16:
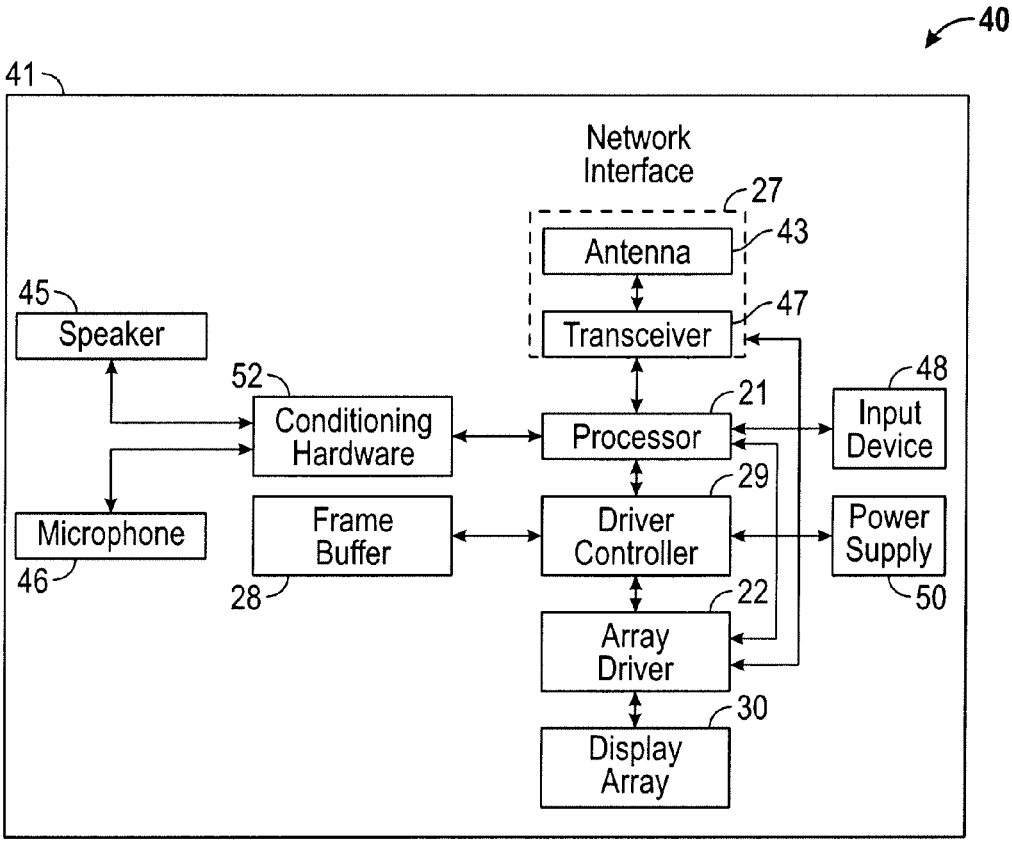

FIGS. 15 and 16 show system block diagrams of an example display device 40 that includes a plurality of display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, electroluminescent (EL) displays, OLED, super twisted nematic (STN) display, LCD, or thin-film transistor (TFT) LCD, or a non-flat-panel display, such as a cathode ray tube (CRT) or other tube device. In addition, the display 30 can include a mechanical light modulator-based display, as described herein.

The components of the display device 40 are schematically illustrated in FIG. 15. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 15, can be configured to function as a memory device and be configured to communicate with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1xEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G technology. The transceiver 47 can preprocess the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a standalone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements. In some implementations, the array driver 22 and the display array 30 are a part of a display module. In some implementations, the driver controller 29, the array driver 22, and the display array 30 are a part of the display module.

In some implementations, the driver controller 29, the array driver 22, and the display array 30 are appropriate for any of the types of displays described herein. For example, the driver controller 29 can be a conventional display controller or a bi-stable display controller (such as a mechanical light modulator display element controller). Additionally, the array driver 22 can be a conventional driver or a bi-stable display driver (such as a mechanical light modulator display element controller). Moreover, the display array 30 can be a conventional display array or a bi-stable display array (such as a display including an array of mechanical light modulator display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The processes of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An apparatus, comprising:

an input configured to receive image data associated with an image frame;

subfield derivation logic configured to derive at least one color subfield for the received image frame, wherein each of the at least one color subfields identifies a color intensity value with respect to each of a plurality of light modulators in a display for the received image frame;

subframe generation logic configured to generate a plurality of subframes for each of the at least one derived color subfields, wherein each generated subframe indicates the states of each of the plurality of light modulator in the display;

dark subframe detection logic configured to identify dark subframes that indicate that at least substantially all light modulators in the display are to be in a non-transmissive state; and output logic configured to:

control the timing of outputting the generated subframes to the plurality of light modulators, control the timing of light source illumination signals output to a display light source for each of the output subframes, and in response to identification by the dark subframe detection logic of a dark subframe, suppress the outputting of the dark subframe, increase an amount of time for which at least one other subframe is displayed based on a timing value associated with the identified dark subframe, and decrease a light source intensity value associated with the display of the at least one other subframe based on the increase in the amount of time for which the at least one other subframe is displayed.

2. The apparatus of claim 1, wherein identifying dark subframes includes identifying subframes in which all light modulators in the display are to be in a non-transmissive state.

3. The apparatus of claim 1, wherein identifying dark subframes includes identifying subframes in which less than a threshold number of light modulators in the display are to be in a non-transmissive state.

4. The apparatus of claim 1, wherein the at least one other subframe is of a color that is different than a color of the identified dark subframe.

5. The apparatus of claim 1, wherein increasing the amount of time for which the at least one other subframe is displayed includes allocating additional time to display subframes of a plurality of colors and such additional time is allocated disproportionately to at least one subframe of a selected color.

6. The apparatus of claim 5, wherein the additional time is disproportionately allocated to at least one subframe of a composite color.

7. The apparatus of claim 1, wherein the at least one other subframe includes all subframes generated for the received image frame other than those identified as being dark subframes.

8. The apparatus of claim 1, wherein increasing the amount of time for which the at least one other subframe is displayed includes increasing a number of times the at least one other subframe is displayed.

9. The apparatus of claim 1, wherein increasing the amount of time for which the at least one other subframe is displayed includes allocating additional time to display at least one subframe of a selected color regardless of the color of the identified dark subframe.

10. The apparatus of claim 9, wherein the selected color is green.

11. The apparatus of claim 9, wherein allocating additional time includes increasing a number of times a green subframe is displayed.

12. The apparatus of claim 1, wherein the at least one other subframe is a composite color subframe.

13. The apparatus of claim 12, wherein increasing the amount of time for which the composite color subframe is displayed includes increasing a number of times the composite color subframe is displayed.

14. The apparatus of claim 12, wherein increasing the amount of time for which the composite color subframe is displayed includes displaying a composite color subframe that would not otherwise have been displayed.

15. The apparatus of claim 1, wherein the output logic is further configured to decrease a slew rate of a driver in association with addressing the display with the at least one other subframe.

16. The apparatus of claim 1, wherein the subfield derivation logic is configured to derive at least three color subfields for each received image frame.

17. The apparatus of claim 1, wherein increasing the amount of time for which the at least one other subframe is displayed includes displaying a subframe that would not otherwise have been displayed.

18. The apparatus of claim 1, wherein suppressing the output of the dark subframe comprises omitting loading the dark subframe into the plurality of light modulators.

19. The apparatus of claim 1, wherein the display light source includes a backlight.

20. The apparatus of claim 1, comprising:

the display;

a processor that is configured to communicate with the display, the processor being configured to process image data; and a memory device that is configured to communicate with the processor.

21. The apparatus of claim 20, wherein the processor includes at least one of the subfield derivation logic, the subframe generation logic, the dark subframe detection logic and the output logic.

22. The apparatus of claim 20, wherein the display includes control logic including at least one of the subfield derivation logic, the subframe generation logic, the dark subframe detection logic and the output logic.

23. The apparatus of claim 22, wherein the control logic comprises a microprocessor and an application specific integrated circuit (ASIC), and at least one of the subfield derivation logic, the subframe generation logic, the dark subframe detection logic and the output logic includes processor executable instructions configured for execution by the microprocessor.

24. The apparatus of claim 20, further comprising:

a driver circuit configured to send at least one signal to the display; and wherein the processor is further configured to send at least a portion of the image data to the driver circuit.

25. The apparatus of claim 20, further comprising:

an image source module configured to send the image data to the processor, wherein the image source module comprises at least one of a receiver, transceiver, and transmitter.

26. The apparatus of claim 20, further comprising:

an input device configured to receive input data and to communicate the input data to the processor.

27. The apparatus of claim 1, wherein identifying dark subframes includes identifying dark subframes among all the generated subframes.

28. An apparatus comprising:

an input configured to receive image data associated with an image frame;

subfield derivation means for deriving at least one color subfield for the received image frame, wherein each of the at least one color subfields identifies a color intensity value with respect to each of a plurality of light modulators in a display for the received image frame;

subframe generation means for generating a plurality of subframes for each of the at least one derived color subfields, wherein each generated subframe indicates the states of each of the plurality of light modulator in the display;

dark subframe detection means for identifying dark subframes that indicate that at least substantially all light modulators in the display are to be in a non-transmissive state; and output control means for controlling the timing of outputting the generated subframes to the plurality of light modulators, controlling the timing of light source illumination signals output to a display light source for each of the output subframes, and, in response to identification by the dark subframe detection means of a dark subframe, for suppressing the outputting of the dark subframe, for increasing an amount of time for which at least one other subframe is displayed based on a timing value associated with the identified dark subframe, and for decreasing a light source intensity value associated with the display of the at least one other subframe based on the increase in the amount of time for which the at least one other subframe is displayed.

29. The apparatus of claim 28, wherein identifying dark subframes includes identifying subframes in which all light modulators in the display are to be in a non-transmissive state.

30. The apparatus of claim 28, wherein identifying dark subframes includes identifying subframes in which less than a threshold number of light modulators in the display are to be in a non-transmissive state.

31. The apparatus of claim 28, wherein the at least one other subframe includes all subframes generated for the received image frame other than those identified as being dark subframes.

32. The apparatus of claim 28, wherein increasing the amount of time for which the at least one other subframe is displayed includes increasing a number of times the at least one other subframe is displayed.

33. The apparatus of claim 28, wherein increasing the amount of time for which the at least one other subframe is displayed includes displaying a subframe that would not otherwise have been displayed.

34. The apparatus of claim 28, wherein the output control means being further for decreasing a slew rate of a driver in association with addressing the display with the at least one other subframe.

35. The apparatus of claim 28, wherein the display light source includes a backlight.

36. The apparatus of claim 28, wherein identifying dark subframes includes identifying dark subframes among all the generated subframes.

37. A method of forming an image on a display, comprising:

receiving image data associated with an image frame;

deriving at least one color subfield for the received image frame, wherein each of the at least one color subfields identifies a color intensity value with respect to each of a plurality of light modulators in a display for the received image frame;

generating a plurality of subframes for each of the at least one derived color subfields, wherein each generated subframe indicates the states of each of the plurality of light modulator in the display;

identifying dark subframes that indicate that at least substantially all light modulators in the display are to be in a non-transmissive state; and controlling the timing of outputting the generated subframes to the plurality of light modulators, controlling the timing of light source illumination signals output to a display light source for each of the output subframes, and, in response to identification of a dark subframe, suppressing the outputting of the dark subframe, increasing an amount of time for which at least one other subframe is displayed based on a timing value associated with the identified dark subframe and decreasing a light source intensity value associated with the display of the at least one other subframe based on the increase in the amount of time for which the at least one other subframe is displayed.

38. The method of claim 37, wherein identifying dark subframes includes identifying subframes in which all light modulators in the display are to be in a non-transmissive state.

39. The method of claim 37, wherein identifying dark subframes includes identifying subframes in which less than a threshold number of light modulators in the display are to be in a non-transmissive state.

40. The method of claim 37, wherein increasing the amount of time for which the at least one other subframe is displayed includes increasing a number of times the at least one other subframe is displayed.

41. The method of claim 37, wherein increasing the amount of time for which the at least one other subframe is displayed includes displaying a subframe that would not otherwise have been displayed.

42. The method of claim 37, further comprising decreasing a slew rate of a driver in association with addressing the display with the at least one other subframe.

43. The method of claim 37, wherein the display light source includes a backlight.

44. The method of claim 37, wherein identifying dark subframes includes identifying dark subframes among all the generated subframes.

* * * * *